US012509260B2

(12) United States Patent
Cabrele et al.

(10) Patent No.: US 12,509,260 B2
(45) Date of Patent: Dec. 30, 2025

(54) CABLE TIE TOOL

(71) Applicant: Illinois Tool Works Inc., Glenview, IL (US)

(72) Inventors: Federico Cabrele, Piazzola (IT); Michele Sala, Montevecchia (IT); Lorenzo Altarino, Padua (IT); Michele Lucon, Padua (IT)

(73) Assignee: Illinois Tool Works Inc., Glenview, IL (US)

( * ) Notice: Subject to any disclaimer, the term of this patent is extended or adjusted under 35 U.S.C. 154(b) by 227 days.

(21) Appl. No.: 18/152,894

(22) Filed: Jan. 11, 2023

(65) Prior Publication Data

US 2023/0219706 A1 Jul. 13, 2023

(30) Foreign Application Priority Data

Jan. 11, 2022 (EP) ..... 22151068
Jan. 10, 2023 (EP) ..... 23150991

(51) Int. Cl.
*B65B 13/22* (2006.01)
*B65B 13/02* (2006.01)

(52) U.S. Cl.
CPC ..... *B65B 13/22* (2013.01); *B65B 13/027* (2013.01)

(58) Field of Classification Search
CPC ..... B65B 13/22; B65B 13/027
See application file for complete search history.

(56) References Cited

U.S. PATENT DOCUMENTS 3,433,275 A 3/1969 Eppler
3,976,108 A 8/1976 Caveney et al.
(Continued)

FOREIGN PATENT DOCUMENTS

DE 29722524 U1 2/1998
DE 102020117522 A1 1/2021
(Continued)

OTHER PUBLICATIONS

English translate (JP2007117055A), retrieved date Dec. 20, 2024.*

*Primary Examiner* — Mohammed S. Alawadi
(74) *Attorney, Agent, or Firm* — Neal, Gerber & Eisenberg LLP

(57) ABSTRACT

A tool for tensioning and severing a cable tie comprising, inter alia, a reel magazine assembly, configured to retainingly receive at least one cable strap reel and provide for a spring-biased rotation of said at least one cable strap reel about a cable strap reel center axis, wherein said spring-biased rotation is directed so as to wind up a cable tie strap coiled up onto said cable strap reel; a feeder guide mechanism, provided within said barrel portion, configured to guidingly receive an end portion of said cable tie strap of said cable strap reel and move said cable tie strap from said cable strap reel through said barrel portion towards said distal housing end portion, but prevent movement of said cable tie strap back towards said cable strap reel; a locking heads magazine assembly, configured to store a plurality of locking heads and supply one locking head at the time for use with said cable tie strap, and a blade guard, operably coupled between said cut-off mechanism and said locking heads magazine assembly, configured to receive and move said locking head from said locking heads magazine assembly into a loading position, ready for engagement with said cable tie strap.

14 Claims, 18 Drawing Sheets

(56) References Cited

U.S. PATENT DOCUMENTS

| | | | | |
|---|---|---|---|---|
| 4,335,477 | A | 6/1982 | Halstead | |
| 4,495,972 | A | 1/1985 | Walker | |
| 4,498,507 | A | 2/1985 | Thompson | |
| 4,862,928 | A | 9/1989 | Caveney et al. | |
| 5,205,328 | A | 4/1993 | Johnson et al. | |
| 5,595,220 | A | 1/1997 | Leban et al. | |
| 5,769,133 | A | 6/1998 | Dyer et al. | |
| 5,921,290 | A | 7/1999 | Dyer et al. | |
| 5,944,064 | A | 8/1999 | Saito et al. | |
| 5,947,166 | A * | 9/1999 | Doyle | E04G 21/122 140/57 |
| D430,781 | S | 9/2000 | Hillegonds | |
| 6,119,734 | A * | 9/2000 | Kurmis | B65B 13/027 140/123.5 |
| 6,206,053 | B1 | 3/2001 | Hillegonds | |
| 6,497,258 | B1 | 12/2002 | Flannery et al. | |
| D473,773 | S | 4/2003 | Hillegonds et al. | |
| D491,430 | S | 6/2004 | Magno et al. | |
| 6,840,289 | B2 | 1/2005 | Hillegonds | |
| 7,086,426 | B2 | 8/2006 | Magno et al. | |
| 7,210,506 | B2 | 5/2007 | Magno | |
| 7,216,679 | B2 | 5/2007 | Magno et al. | |
| D543,811 | S | 6/2007 | Lueschen | |
| 7,231,944 | B2 | 6/2007 | Magno et al. | |
| D547,626 | S | 7/2007 | Lueschen | |
| 7,299,830 | B2 | 11/2007 | Levin et al. | |
| D692,738 | S | 11/2013 | Dyer | |
| 8,955,556 | B2 | 2/2015 | Myers et al. | |
| 8,960,241 | B2 | 2/2015 | Dyer | |
| D758,155 | S | 6/2016 | Kruzel | |
| 9,394,067 | B2 | 7/2016 | Dyer | |
| 9,394,068 | B2 | 7/2016 | Dyer | |
| 9,550,590 | B2 | 1/2017 | Dyer | |
| 9,694,924 | B2 | 7/2017 | Myers et al. | |
| D818,787 | S | 5/2018 | Kitago | |
| D885,861 | S | 6/2020 | Ni | |
| 11,827,394 | B2 | 11/2023 | Hempe et al. | |
| 2004/0079436 | A1 | 4/2004 | Hillegonds | |
| 2005/0178460 | A1 | 8/2005 | Magno | |
| 2005/0178461 | A1 | 8/2005 | Magno et al. | |
| 2013/0167970 | A1 | 7/2013 | Dyer | |
| 2016/0167813 | A1 | 6/2016 | Myers | |
| 2017/0057674 | A1 | 3/2017 | Myers | |
| 2019/0127095 | A1 | 5/2019 | Kitago | |
| 2019/0193879 | A1 * | 6/2019 | Yamamoto | B65B 13/22 |
| 2020/0180799 | A1 | 6/2020 | Ni | |
| 2023/0219706 | A1 | 7/2023 | Cabrele et al. | |

FOREIGN PATENT DOCUMENTS

| | | | |
|---|---|---|---|
| EP | 1108649 | A2 | 6/2001 |
| GB | 1094469 | A | 12/1967 |
| JP | S5974017 | A | 4/1984 |
| JP | 2007117055 | A * | 5/2007 |
| JP | 6010119 | B2 | 9/2016 |
| JP | 6174495 | B2 | 7/2017 |
| JP | 6288801 | B2 | 2/2018 |
| WO | 2013003471 | A1 | 1/2013 |
| WO | 2022251113 | A1 | 12/2022 |

* cited by examiner (a)

(b)

(a)

(b)

(a)

(b)

(a)

(b)

(a)

(b)

(a)

(b)

(a) (b)

(c) (d)

(e)

CABLE TIE TOOL

CROSS-REFERENCE TO RELATED APPLICATIONS

This application is related to the following commonly owned co-pending patent applications: U.S. application Ser. No. 29/870,400, entitled "SMART CABLE TIE TOOL," and U.S. application Ser. No. 29/870,408, entitled "CABLE TIE TOOL,".

TECHNICAL FIELD

The present disclosure relates to hand-held tensioning and cutting tools and in particular, to an improved hand tool for tensioning and cutting cable ties including a magazine and cable/locking head feeder mechanism.

BACKGROUND

Cable ties, also known as zip ties or hose ties, are widely used in a variety of environments and applications. For example, cable ties may be used to securely bundle a plurality of wires, cables, or conduits such as those found in the automotive industry. Also, cable ties may be used to secure articles to rigid structures (e.g., a chassis) but may also be utilized as hose clamps. Typically, a cable tie comprises a tie head portion and a tie tail portion of various lengths that is integrally formed with the head portion. During use, the tie tail is threaded through the tie head so as to encircle the articles to be bound or secured. The tie tail section is usually provided with teeth that engage with a pawl provided in the tie head and forming a ratchet so that, as the free end of the tie tail is pulled, the cable tie tightens and does not come undone. Once the tie tail of the cable tie has been pulled through the tie head and past the ratchet, it is prevented from being pulled back, thus, the resulting loop may only be pulled tighter. Some cable ties may include a tab that can be depressed to release the ratchet so that the cable tie can be loosened or be removed and possibly reused.

A cable tie tensioning device, also known as cable tie tool or cable tie gun, may be used to install cable ties and apply a predefined degree of tension, as well as, cut off the extra tail. Preferably, the cut tie tail is flush with the tie head portion so as to avoid sharp edges, which might otherwise cause injuries. Light-duty tools may be operated by simply and repeatedly squeezing the handle and trigger with the fingers until a desired tension of the cable tie has been reached to then cut off the tail section of the tightened cable tie. Heavy-duty or automated tools may be powered, for example, by compressed air or a solenoid (i.e., actuator) to assist the user when operating the tool. In addition, other binding tools or cable tie tools exist including a magazine or magazines that comprise(s) a plurality of either separate cable ties including heads, or a long reeled up cable strap and separate locking heads to be used with the strap. Such known tools using reeled cable straps are relatively complicated mechanisms that often utilize electronically powered components to tension and cut a desired length of cable tie that is used to secure or bundle up one or more structures.

Even more, the currently known "magazine" cable tie tools can be fairly inaccurate when cutting the straps, also including relatively large electric power sources or power connectors, thus, making the tool rather weighty and cumbersome. As a result, the relatively complicated and cumbersome tools are expensive to manufacture (e.g., requiring batteries or power cords, as well as motor(s) or actuators etc.), and more likely to fail or break from wear and tear.

Accordingly, in various embodiments, the present disclosure provides an improved, as well as a simplified cable tie tool for tensioning and cutting cable ties provided from a strap magazine storing a predetermined amount of cable strap, and a tie head magazine housing a plurality of locking heads to be used with the cable strap without the need to load individual cable ties for each use. Further, in various embodiments, the present disclosure provides a cable tie tool with a cable strap magazine operable without the need of a power source (e.g., electric, pneumatic, hydraulic, or the like).

SUMMARY

Various embodiments of the present disclosure provide a tool for tensioning and severing a cable tie, the tool comprising: (a) a pistol-shaped housing, having a barrel portion extending between a distal housing end portion and a proximal housing end portion along a longitudinal axis, and a handle portion extending away from said barrel portion in a direction different to said longitudinal axis; (b) a trigger mechanism, comprising an elongate trigger member extending away from said barrel portion operably forward of said handle portion and configured to move toward and away from said handle portion; (c) a tension mechanism, comprising a pawl link provided slidably reciprocatingly within said barrel portion along said longitudinal axis and operably coupled to said trigger mechanism, configured to grippingly engage the cable tie and apply tension to the tie tail when moving said elongate trigger member toward said handle portion, during use; (d) a locking mechanism, provided within said barrel portion and operably coupled with said tension mechanism, configured to stop operation of and lock said tension mechanism at a predetermined tension of the tie tail; (e) a cut-off mechanism, provided within said barrel portion and operably coupled with said trigger mechanism and said locking mechanism, configured to cut the tie tail when said locking mechanism is lockingly actuated; (f) a reel magazine assembly, configured to retainingly receive at least one cable strap reel and provide for a spring-biased rotation of said at least one cable strap reel about a cable strap reel center axis, wherein said spring-biased rotation is directed so as to wind up a cable tie strap coiled up onto said cable strap reel; (g) a feeder guide mechanism, provided within said barrel portion, configured to guidingly receive an end portion of said cable tie strap of said cable strap reel and move said cable tie strap from said cable strap reel through said barrel portion towards said distal housing end portion, but prevent movement of said cable tie strap back towards said cable strap reel; (h) a locking heads magazine assembly, configured to store a plurality of locking heads and supply one locking head at the time for use with said cable tie strap, and (i) a blade guard, operably coupled between said cut-off mechanism and said locking heads magazine assembly, configured to receive and move said locking head from said locking heads magazine assembly into a loading position, ready for engagement with said cable tie strap.

Advantageously, in various embodiments said blade guard is moveable between a first position, retaining said locking head in said loading position, and a second position, releasing said locking head through an aperture of said blade guard, while moving another one of said plurality of locking heads into said loading position.

Advantageously, in various embodiments said blade guard comprises a blade member configured to cut through said cable tie strap when moved into said second position.

Advantageously, in various embodiments movement of said blade guard is actuated by said cut-off mechanism.

Advantageously, in various embodiments said reel magazine assembly further comprises a reel biasing mechanism configured to provide said spring biased rotation and selectively releasably couplable with a hub member receiving said cable strap reel.

Advantageously, in various embodiments said reel magazine assembly further comprises a release mechanism configured to disengage said reel biasing mechanism from said hub member.

Advantageously, in various embodiments said feeder guide mechanism further comprises a roller guide configured to enable movement of said cable tie strap towards said distal housing end portion and prevent movement of said cable tie strap back towards said cable strap reel.

Advantageously, in various embodiments said feeder guide mechanism further comprises a manual slider mechanism, configured to grippingly engage with a portion of said cable tie strap and slidingly move between a first trigger position, adjacent to said roller guide, and a second trigger position, spaced apart from said roller guide towards said distal housing end portion.

Advantageously, in various embodiments said manual slider mechanism is biased towards said first trigger position.

Advantageously, in various embodiments said locking heads magazine assembly is configured to bias said plurality of locking heads towards said blade guard, during use.

Advantageously, in various embodiments said locking heads magazine assembly is configured to retain two parallelly arranged rows of said plurality of locking heads, such that one row of said plurality of locking heads is axially offset relative to the other row of said plurality of locking heads, by a distance equivalent to half the thickness of one of said plurality of locking heads.

Advantageously, in various embodiments said locking heads magazine assembly further comprises a level indicator, configured to indicate the number of locking heads left in said locking heads magazine assembly.

Advantageously, in various embodiments said locking heads magazine assembly further comprises a pivot cover, movable between a closed position, covering said plurality of locking heads, and an open position, enables access to said plurality of locking heads.

Advantageously, in various embodiments said pivot cover is biased towards said open position and lockingly engaged with a releasable hook mechanism when in said closed position.

BRIEF DESCRIPTION OF THE DRAWINGS

Exemplary embodiments of the present disclosure are explained in more detail hereinbelow with reference to the figures.

DETAILED DESCRIPTION

Figure 1:
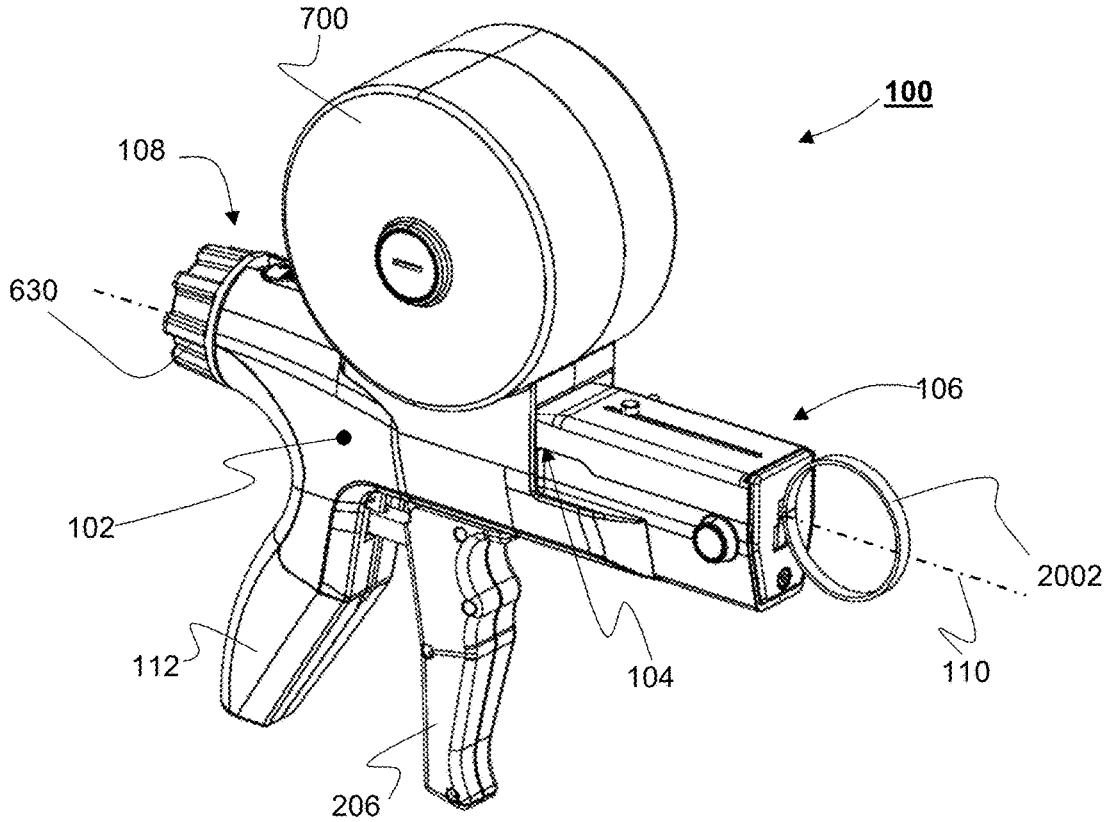
FIG. 1 illustrates (a) a perspective front view and (b) a perspective rear view of a preferred embodiment of the cable tie tool of the present disclosure.
Figure 1:
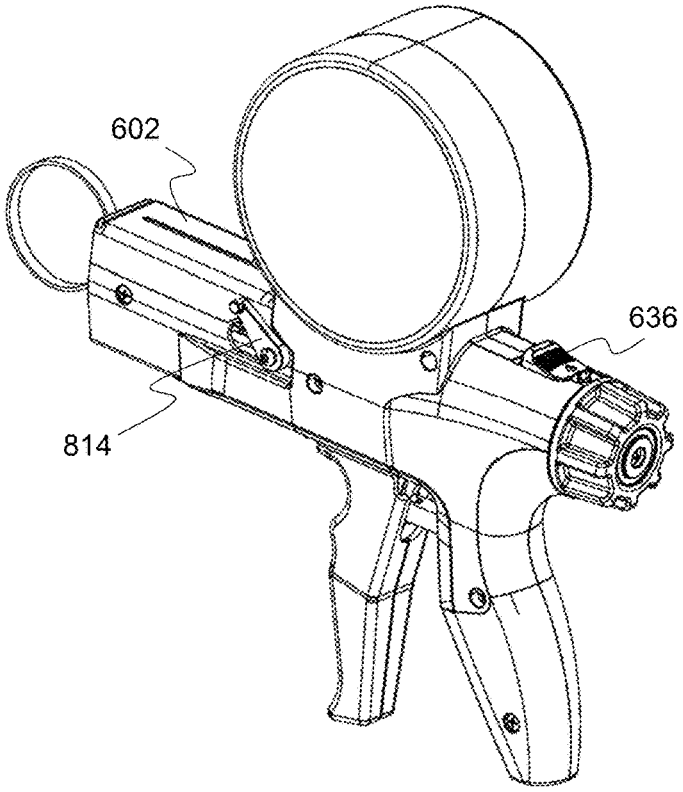

While the systems, devices, and methods described herein may be embodied in various forms, the drawings show, and the specification describes certain exemplary and non-limiting embodiments. Not all components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

The described example embodiments relate to a hand-held tensioning and cutting tool such as a cable tie tool for use with a reeled cable tie strap (magazine) and separately stored locking heads (magazine). However, the present disclosure is not limited to hand-held devices with manual tool mechanisms and may be used for any tool suitable for tensioning and cutting cable ties, including tools using electric or pneumatic motors etc.

Certain terminology is used in the following description for convenience only and is not limiting. The words 'right', 'left', 'lower', 'upper', 'front', 'rear', 'upward', 'down', 'downward', 'above' and 'below' designate directions in the drawings to which reference is made and are with respect to the described component when assembled and mounted (e.g., in situ). In particular, the designated directions used in the description are with respect to the hand-held tool held by the user in a normal, upright position (i.e., the handle portion pointing downwards and the barrel portion pointing forward and away from the user). It is understood that the tool may be used in any other orientation suitable for the job at hand, though, for simplicity, the designated directions are used when the tool is in a "normal" orientation. The words 'inner', 'inwardly' and 'outer', 'outwardly' refer to directions toward and away from, respectively, a designated centerline or a geometric center of an element being described (e.g., central axis), the particular meaning being readily apparent from the context of the description.

Further, as used herein, the terms 'connected', 'attached', 'coupled', 'mounted' are intended to include direct connections between two members without any other members interposed therebetween, as well as indirect connections between members in which one or more other members are interposed therebetween. The terminology includes the words specifically mentioned above, derivatives thereof, and words of similar import.

Further, unless otherwise specified, the use of ordinal adjectives, such as, 'first', 'second', 'third' etc. merely indicate that different instances of like objects are being referred to and are not intended to imply that the objects so described must be in a given sequence, either temporally, spatially, in ranking or in any other manner.

Through the description and claims of this specification, the terms 'comprise' and 'contain', and variations thereof, are interpreted to mean 'including but not limited to', and they are not intended to (and do not) exclude other moieties, additives, components, integers, or steps. Throughout the description and claims of this specification, the singular encompasses the plural unless the context otherwise requires. In particular, where the indefinite article is used, the specification is to be understood as contemplating plurality, as well as, singularity, unless the context requires otherwise.

Features, integers, characteristics, compounds, chemical moieties, or groups described in conjunction with a particular aspect, embodiment or example of the present disclosure are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The present disclosure is not restricted to the details of any foregoing embodiments. The present disclosure extends to any novel one, or any novel combination, of the features disclosed in this specification (including any accompanying claims, abstract or drawings), or to any novel one, or any novel combination, of the steps of any method or process so disclosed.

Referring now to FIGS. 1 to 4, an example embodiment of the cable tie tool 100 incorporating certain principles of the present disclosure is provided in a pistol shape and intended to be hand-held by the user. The cable tie tool 100 comprises a housing 102 having a barrel portion 104 extending along a longitudinal axis 110 between a distal housing end portion 106 and a proximal housing end portion 108. A handle portion 112 extends away from the proximal housing end portion 108 in a direction intersecting with the longitudinal axis 110, for example, at an angle between 60° and 90° with respect to the longitudinal axis 110. The housing 102 may further comprise a trigger housing 206. An adjustment knob 630 and a biased locking switch 636 is provided at the proximal housing end portion 108.

A magazine 700 for a cable strap reel (inside) is provided on top of the barrel portion 104 and operably coupled with the tool mechanisms, so as to feed the coiled or reeled cable strap 2002 into the barrel portion 104 of the tool 100.

Figure 2:
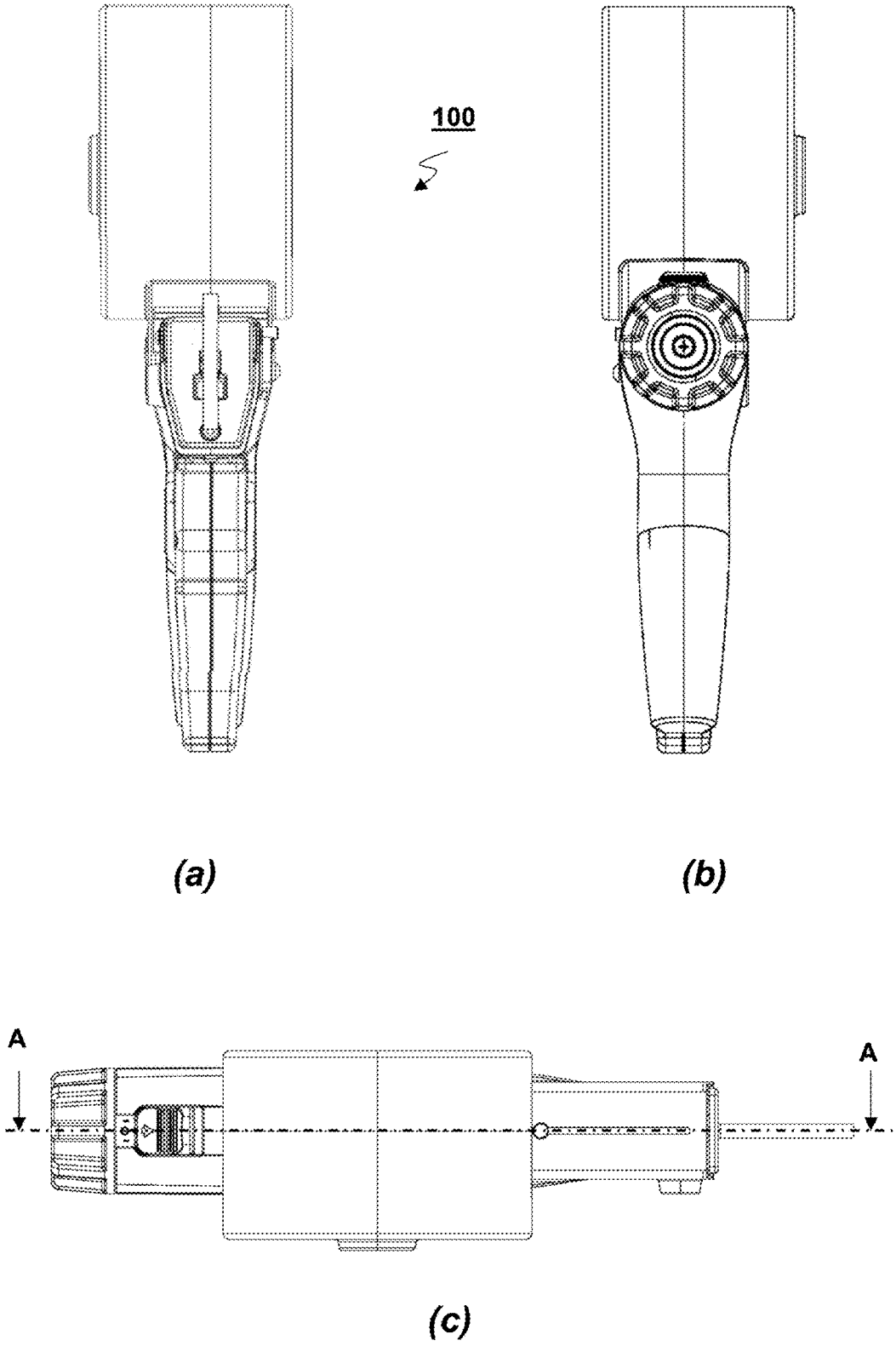
FIG. 2 illustrates (a) a front view, (b) a rear view and (c) a top view of the preferred embodiment of the cable tie tool of the present disclosure.

FIGS. 2 (*a*) to (*c*) shows the cable tie tool 100 in respective (a) front-view (distal end), (b) rear-view (proximal end) and (c) top-view.

Figure 3:
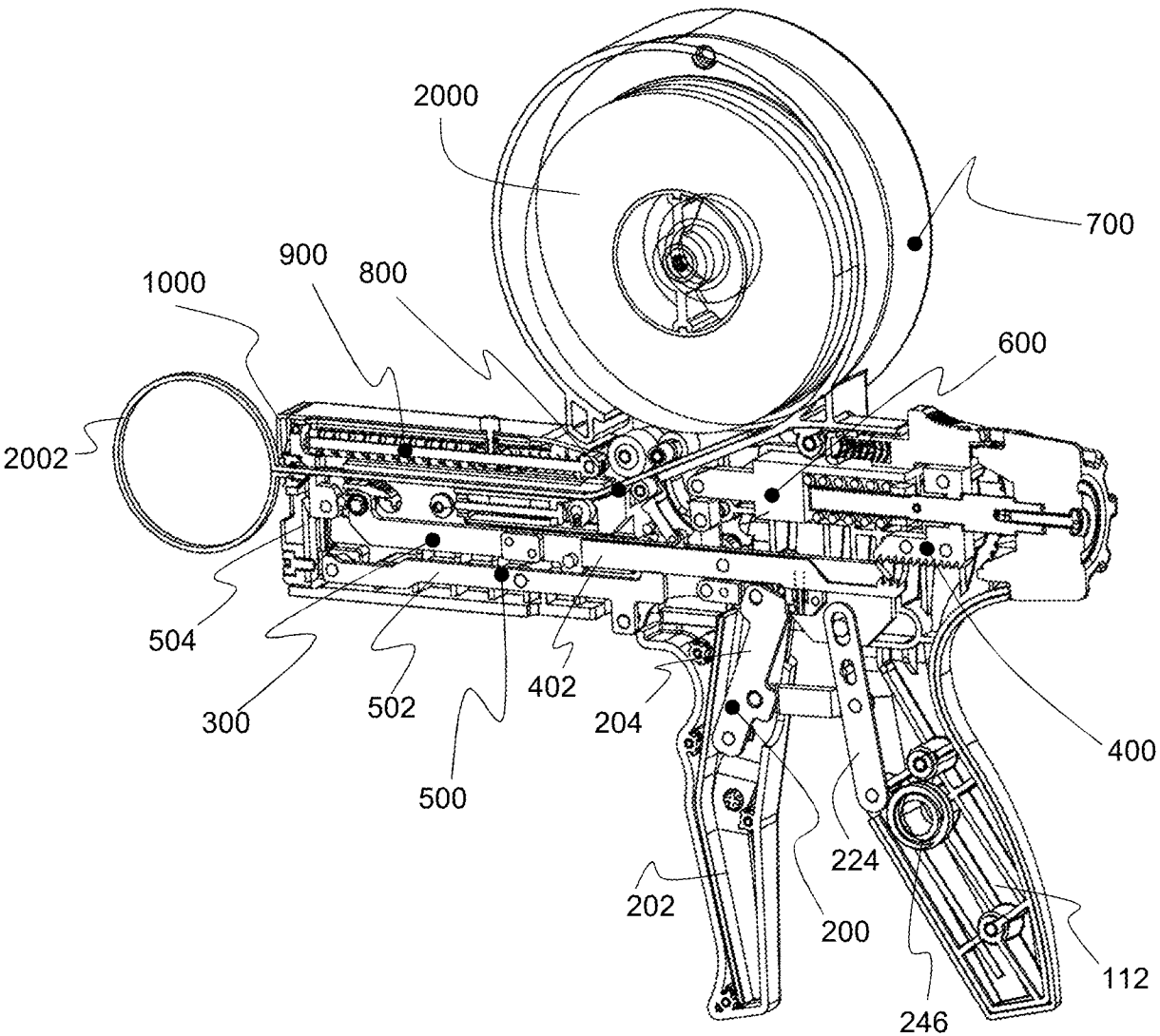
FIG. 3 illustrates a cross-section side view along A-A of the cable tie tool of FIG. 2(*c*).

FIG. 3 shows a cross-sectional view (along center plane A-A, see FIG. 2(*c*)) of the cable tie tool 100 illustrating the mechanism(s) operably embedded within the housing 102. For a better understanding, the tool mechanism has been divided into separate functional groups with respective ones operably coupled to one another, so as to provide the desired functions of the tool 100. These functional groups include a trigger mechanism 200, mostly embedded within the handle portion 112 and trigger housing portion 206 and configured to be moved by the user's hand during operation, a tension mechanism 300, embedded within the barrel portion 104 and configured to grippingly engage the cable tie tail and apply a predetermined maximum tension, a locking mechanism 400, embedded within the barrel portion 104 and configured to lock the trigger mechanism 200 and tensioning mechanism 300 at the predetermined (i.e., selected) maximum tension applied to the cable tie tail during use, a cut-off mechanism 500, partly embedded within the barrel portion 104 and at the distal housing end portion 106 of the tool 100 and configured to cut through the cable tie strap 2002 when the predetermined tension applied to the cable tie tail is reached, and an adjustable biasing mechanism 600, partly embedded within the proximal housing end portion 108 of the barrel portion 104 and configured to adjust the biasing force defining the maximum tension applied to the cable tie tail, during use. These functional groups (i.e., 200, 300, 400, 500 and 600) have been described in great detail in an earlier patent application no. EP21211181.9 (hereby incorporated by reference in its entirety) and are therefore only summarized in the following sections (i) to (v).

(i) Trigger Mechanism 200

The trigger mechanism 200 is the main actuator of the cable tie tool 100. In operation, the user grips the handle portion 112 with the palm of one hand and uses the fingers of that hand to squeeze the trigger lever 202 towards the handle portion 112. When releasing the pressure provided by the user's fingers, the trigger lever 202 is urged back into its starting position via a biasing member (i.e., a spring) 246 operably embedded into the handle portion 112 and coupled to a handle lever 224. Repeated movement of the trigger lever 112 will pull the looped tie tail back and apply a tension.

The trigger mechanism 200 is partially integrated into the handle portion 112 of the housing 102. The elongate trigger lever 202 is located forwardly of the handle portion 112 and pivotably mounted within the housing 102 at its proximal (or upper) end so as to enable movement about a substantially horizontal pivot axis. The trigger lever 202 may include two substantially parallel spaced side faces 210*a* and 210*b* and a front face 212 forming a generally U-shaped profile with an elongate recess. Thus, the trigger lever 202 is movable from an initial forward position to a final rearward position and back to its initial forward position. An inner trigger link 204 extends upwardly within the elongate recess of the trigger lever, a lower link end of the inner trigger link 204 is pivotally joined to the trigger lever 202 for pivot movement about a substantially horizontal pivot axis. The upper link end of the inner trigger link 204 comprises an elongate aperture (see FIG. 3) suitable to operably link to the cutting mechanism 500 (described in a following section). The handle lever 224 is pivotally coupled at its lower (distal) lever end at a pivot axis within the handle portion 112 of housing 102 and its upper (proximal) lever end is operably coupled to a proximal end of a pawl link 302 of the tension mechanism 300 (described in a subsequent section). The handle lever 224 is pivotally movable about its pivot axis between a forward position (relative to the handle portion) and a rearward position within the handle portion 112. The handle lever 224 is biased towards its forward position by the biasing member 246, such as, for example, a coil spring or a leaf spring or a torsion spring, or any other spring element suitable to urge the handle lever 224 into its forward position.

A forward end of a short link 230 is pivotally joined to the inner trigger link 204 and a rearward end of the short link 230 is pivotally joined to the handle lever 224. Each one of the forward end and the rearward end are configured to enable pivot movement about respective pivot axes and. A trigger bearing (not shown) may be provided at the coupling of the upper lever end of the handle lever 224 coupled within the housing 102 such that the tension mechanism 300 movement is limited to a horizontal, linear reciprocal movement relative to the housing 102, i.e. the housing 102 is provided with a first cam or guide surface configured to guidingly engage with respective trigger bearing such that pivotal movement of the handle lever 224 about its pivot axis is translated into to a linear movement of the operably coupled pawl link 302.

(ii) Tension Mechanism 300

The tension mechanism 300 is operably linked to and actuated by the trigger mechanism 200 in order to securely grip the inserted tie tail of the cable tie and pull the engaged tie tail backwards (i.e., towards the proximal end portion of the tool 100), thus, tightening the cable tie around the bundle of components until a predetermined maximum tension of the tie tail is reached.

In this example embodiment, the tension mechanism 300 comprises a pawl link 302 mounted for horizontal, linear reciprocal movement relative to the housing 102. The pawl link 302 is guidingly supported for linear movement via suitable link bearings (not shown in any more detail) configured to operably engage with a suitable second cam surface or guide of the housing 102 (see section (i)). A gripping pawl 310 is operably mounted to the distal end portion of the pawl link 302. Here, in this particular example embodiment, the gripping pawl 310 is rotatably attached to the pawl link, so as to enable pivot movement between a lower position and an upper position relative to the pawl link 302. The distal end portion of the pawl link 302 further comprises a backing plate or backing portion arranged so as to trappingly or grippingly engage the tie tail in cooperation with the gripping pawl 310 when in its upper position. A spring member (not shown) provides a bias of the gripping pawl 310 towards its upper position (i.e., towards the backing plate). Here, any suitable biasing member may be used to provide a spring bias. Alternatively, the gripping pawl (not shown) may be slidably mounted with the pawl link 302, so as to enable sliding movement between a lower, rearward position and an upper, forward position relative to the pawl link 302.

The pawl link 302 comprises two parallel arranged symmetrical pawl link members configured to sandwichingly mount the gripping pawl 310, therebetween.

A proximal end portion of the pawl link comprises a bearing pin configured to receive the trigger bearings, as well as pivotally couple with the upper lever end of the handle lever 224 via its elongated aperture. The elongate aperture is shaped so as to enable an arcuate trajectory of the handle lever 224 about its pivot axis while the pawl link 302 is moved horizontally linearly.

(iii) Locking Mechanism 400

The locking mechanism 400 is operably coupled with the tension mechanism 300 and its function is to lock the movement of the pawl link 302 (i.e., interrupt the backward movement of the pawl link) and initiate the actuation of the cutting mechanism 500 when reaching a predetermined tension applied to the tie tail, during use.

The locking mechanism 400 comprises a locking lever 402 arranged adjacent to and substantially in parallel with a proximal section of the pawl link 302 between a proximal lever end 406 and a distal lever end. A contact surface (in an alternative embodiment the contact surface could also be a contact protrusion) is facing downwards from its distal lever end and a stop member (i.e., a plurality of teeth) is protruding upwards from its proximal lever end (i.e., in an opposite direction of the contact surface). The locking lever 402 is pivotally coupled with the pawl link 302 via a fulcrum pin, thus, enabling the locking lever 402 to rotate about the fulcrum pin with respect to the pawl link 302 between an engaged, locked position (i.e., teeth 426 of stop member 402 lockingly engage with corresponding teeth of a rack member 414) and a disengaged, unlocked position (i.e., disengaged from the rack member 414).

The lower contact surface of the distal lever end is configured to contactingly engage with a contact portion situated on an upper surface of the cutting lever 502. A rack member 414 is mounted to the housing 102 and within the biasing mechanism group 600 and orientated so as to operably face in a direction of the stop member 404 (e.g., an array of equidistantly arranged teeth). This enables locking engagement between the teeth 426 of the stop member 404 and the teeth of the rack member 414 when the locking lever 402 is rotated into its locked position.

A lever support member (as explained in EP21211181.9 in more detail) is mounted to the proximal end portion of the pawl link 302 and configured to support the proximal lever end when in its unlocked position. The lever support member comprises a spring element operably embedded within the support surface of the lever support member and configured to bias the proximal lever end towards its locked position (i.e., towards the rack member). This bias is counteracted by the contact portion of the cutting lever 502 when the cutting lever 502 is pivoted into its upper position (i.e., blade is retracted). In this example, the locking lever 402 and lever support member are "sandwiched" or operably installed between the two assembled pawl link members 302.

(iv) Cut-Off Mechanism 500

The cut-off mechanism 500 cuts or severs the engaged cable tie tail when a predetermined tension is reached. The cut-off mechanism 500 is directly coupled with the trigger mechanism 200 (via inner trigger link 204) and the adjustable biasing mechanism 600 (via fulcrumed lever link 602 about its fulcrum pin), as well as, operably engaged with the locking mechanism 400 (via its contact portion).

The cut-off mechanism 500 is arranged within the barrel portion 104 of the housing 102 below and substantially parallel to the pawl link 302 and comprises a cutting lever 502 operably coupled to a blade member 504 on its distal cutting lever end (via a movable blade guard 1000) and having a contact portion (protruding towards the pawl link 302) on its proximal cutting lever end. The cutting lever 502 is pivotally coupled to the housing 102 via a fulcrum pin, so as to enable rotation of the cutting lever 502 about the fulcrum pin relative to the housing 102, as well as, relative to the reciprocatingly movable pawl link 302. The blade member 504 is arranged with the movable blade guard 1000 (described in more detail in section (iv)) forward of the distal housing end portion 106 mounted to the tension mechanism 300 (i.e., forward of the gripping pawl) and is operably encased by the movable blade guard 1000 (see FIG. 7(*b*)).

The cutting lever 502 is configured to move between an upper position (i.e., blade member 504 is cuttingly engaged with the tie tail) and a lower position, blade member 504 is disengaged from the tie tail. When the blade member 504 is in the lower position, the contact portion at the proximal end is supportingly engaging the distal lever end of the locking lever 402 of the locking mechanism 400 (i.e., pushing the distal lever end of the locking lever 402 into its upper position).

A cutting linkage 514 is coupled to the proximal cutting lever end so as to operably link the cutting lever 502 with the inner trigger link 204 of the trigger mechanism 200. In particular, the cutting linkage 514 comprises a pivot link (e.g., two parallel pivot link members) 516 directly and pivotally coupled to the proximal cutting lever end via a pivot pin, and a sliding link (not shown) operably coupled between the pivot link 516 (via pivot pin) and the inner trigger link 204. The sliding link is slidingly retained by a third cam surface or guide within the housing 102 via a cam follower so as to only allow reciprocating linear movement of the sliding link between a forward (distal) position and a rearward (proximal) position. Here, the sliding link is provided with a pin configured to slidingly engage with the complementary cam guide of the housing 102.

Tension springs 528 (e.g., coils springs) are provided between the pivot link 516 and the lever link 602, so as to bias the pivot link 516 and the distal cutting lever end towards respective upper positions.

During use, a force acting on the sliding link is provided by the inner trigger link 204. When the predetermined maximum tension is reached with the handle lever 224 pushed back against the housing 102, any additional pull on the trigger lever 202 will rotatingly push the inner trigger link 204 and sliding link forward. As the pivot pin of pivot link 516 is forced linearly forward, the pivot link 516 can only rotatingly move away about its pivot pin, thus, moving the proximal cutting lever end downward (enabling the distal lever end of the locking lever 402 to pivot down) and the blade member 504 upward. Thus, the force acting on the sliding link is translated into a rotational movement of the cutting lever 502 about its fulcrum pin.

(v) Adjustable Biasing Mechanism 600

The adjustable biasing mechanism 600 provides for a selectively adjustable biasing force setting the maximum tension applied to the cable tie at which the tie tail section is cut off. The adjustable biasing mechanism 600 is operably coupled with the cut-off mechanism 500 and the trigger mechanism 200 via the fulcrumed lever link 602 and operably incorporates the rack member 414 of the locking mechanism 400.

The adjustable biasing mechanism 600 includes a spring housing 610 having a coupling member extending away from a distal end of the spring housing 610 (i.e., towards the distal cutting lever end) and is configured to receive a spring member such as a coil spring, as well as a plunger member. The plunger member is slidably movable within the spring housing 610, so as to compress the torsion spring when moving towards the distal end of the spring housing 610 and expand the torsion spring when moving back towards a proximal end of the spring housing 610. Furthermore, the plunger member comprises two radially opposing lateral protrusions configured to slide into respective guide grooves (or longitudinal apertures) formed within the spring housing 610, so as to prevent rotation of the plunger member, during use. A lead screw mechanism is operably coupled with the plunger member and mounted within the housing 102 such that rotation of a proximal end portion of the lead screw mechanism is translated into linear axial movement of plunger member. The rotation of the proximal end portion may be provided by the user via an adjustment knob 630 coupled to the proximal end portion of the lead screw mechanism. Thus, when the user rotates the adjustment knob 630, the lead screw mechanism moves the plunger member distal or proximal within the spring housing 610 to either compress or expand the coil spring within the spring housing 610. Lead screw mechanisms, such as the one illustrated, are well known in the art and are not described in any more detail.

The position of the plunger member within its spring housing 610 determines the precompression of the torsion spring and thus, controls the biasing force provided by the adjustable biasing mechanism 600 via the fulcrumed lever link 602. A thrust bearing may be provided between the lead screw mechanism and the rack member 414 in order to prevent the transmission of any axial pressure to the adjustment knob 630.

Additionally, and optionally, a gear mechanism, such as a spin or torque multiplier, may be operably coupled between the adjustment knob and the proximal end portion of the lead screw mechanism.

(vi) Mechanisms 700, 800, 900, and 1000

The present application provide the following additional functional groups including a magazine assembly 700, configured to operably store one or more cable strap reels 2000, a feeder guide mechanism 800, configured to pull and guide the reeled strap 2002 from the magazine 700 towards and out of the distal end 106 of the tool 100, a locking head magazine assembly 900, configured to hold a plurality of separate locking heads 906 and automatically position a locking head 906 for use with the engaged cable tie strap 2002, and a movable blade guard 1000 (introduced in section (iv)), configured to cut the engaged cable tie strap 2002, in use, and release the locked and cut cable tie so as to operably position another locking head 906 ready for the next use.

Figure 4:
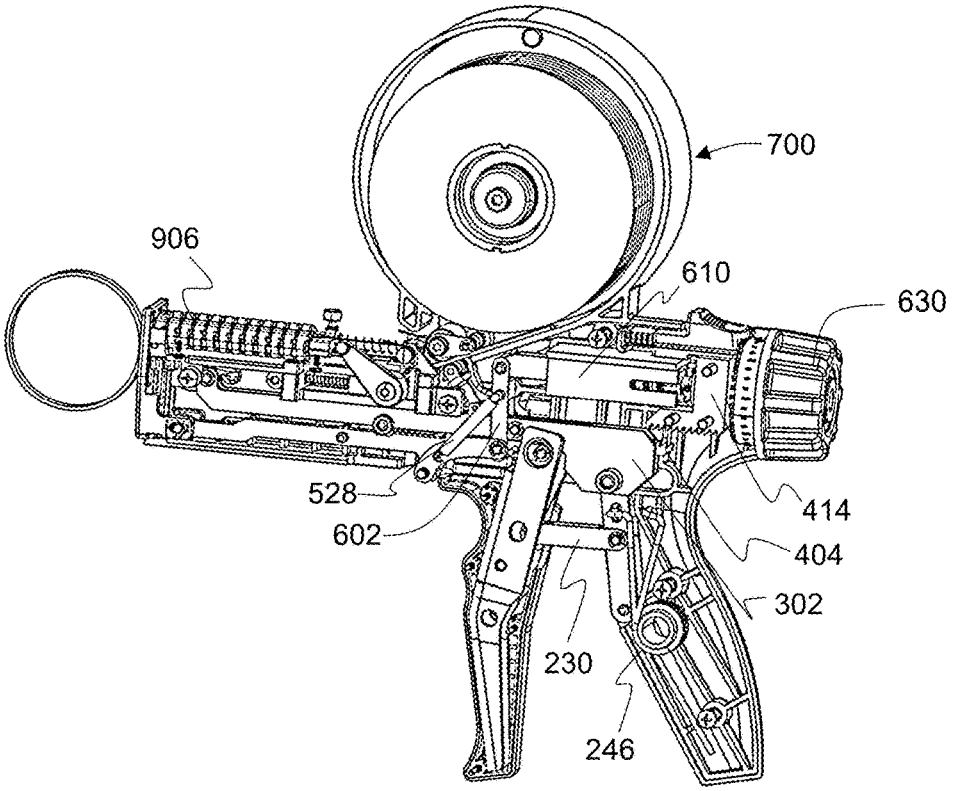
FIG. 4 illustrates (a) a perspective side view of the preferred embodiment of the assembled cable tie tool with the front tool housing removed, and (b) a side-view of the preferred embodiment of the assembled cable tie tool with the full housing removed.
Figure 4:
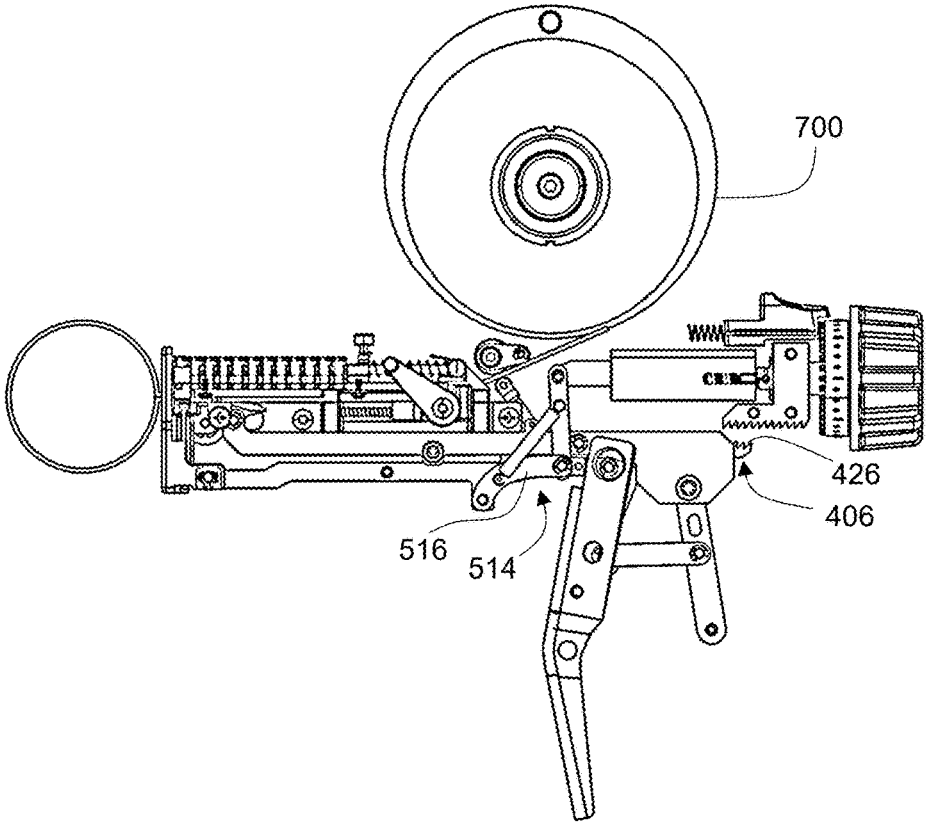

FIGS. 4(*a*) and (*b*) illustrate perspective- and side-view of the tool 100 with the housing removed. It is understood that any one of the respective functional groups 200, 300, 400, 500, 600, 700, 800, 900 and 1000 is partially interconnected with another functional group, and a part of one functional group may also be a component of, or at least operably coupled with, another functional group.

For simplicity and a better understanding, each one of the functional groups 700, 800, 900 and 1000 of the present disclosure is first described separately, before the cable tie strap pull-in function and combination with the locking heads 906 is described as a whole.

(vii) Magazine Assembly 700

Figure 5:
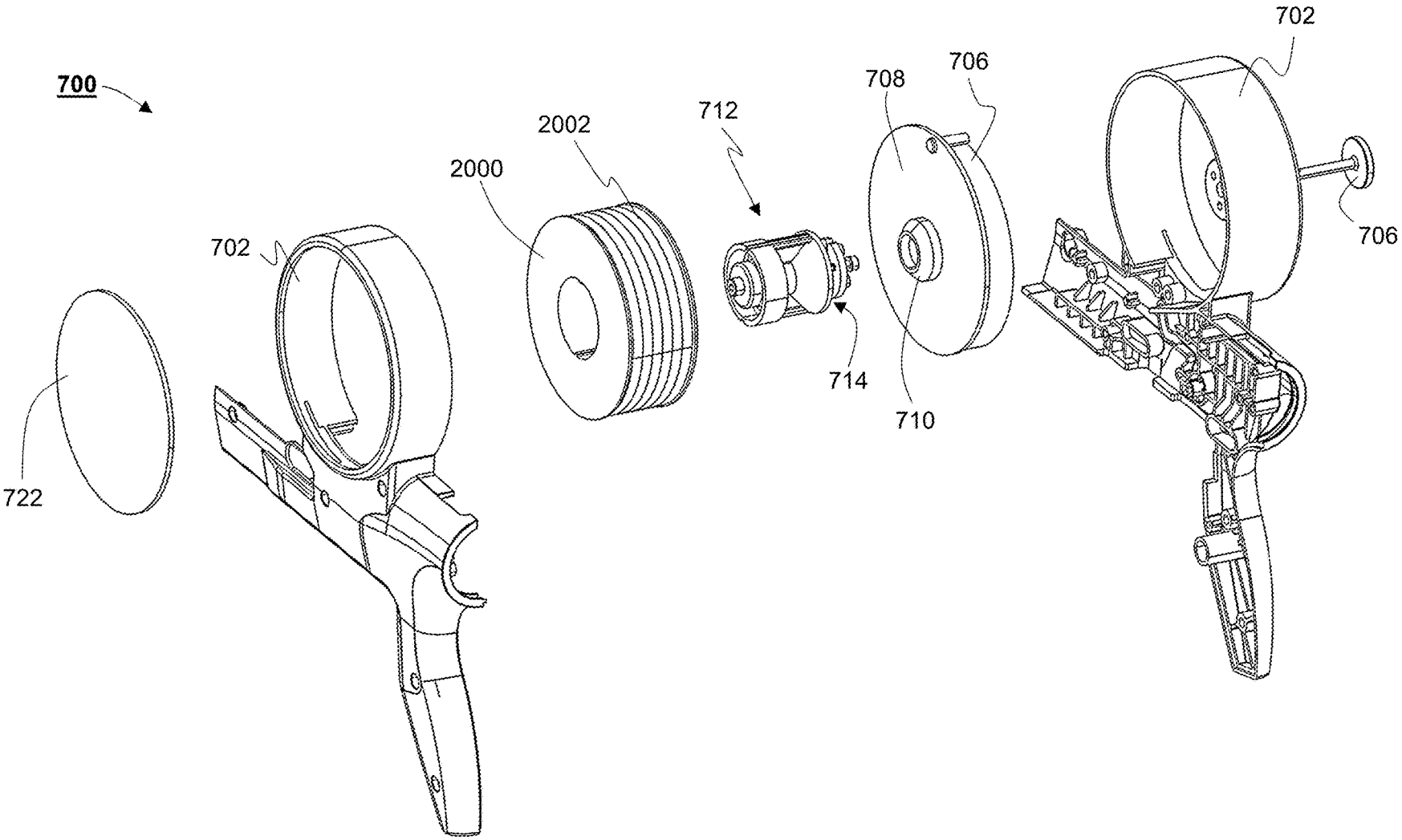
FIG. 5 illustrates an exploded perspective left-side rear view of the cable tie tool housing and reel magazine assembly, with the other mechanisms removed for simplicity.
Figure 6:
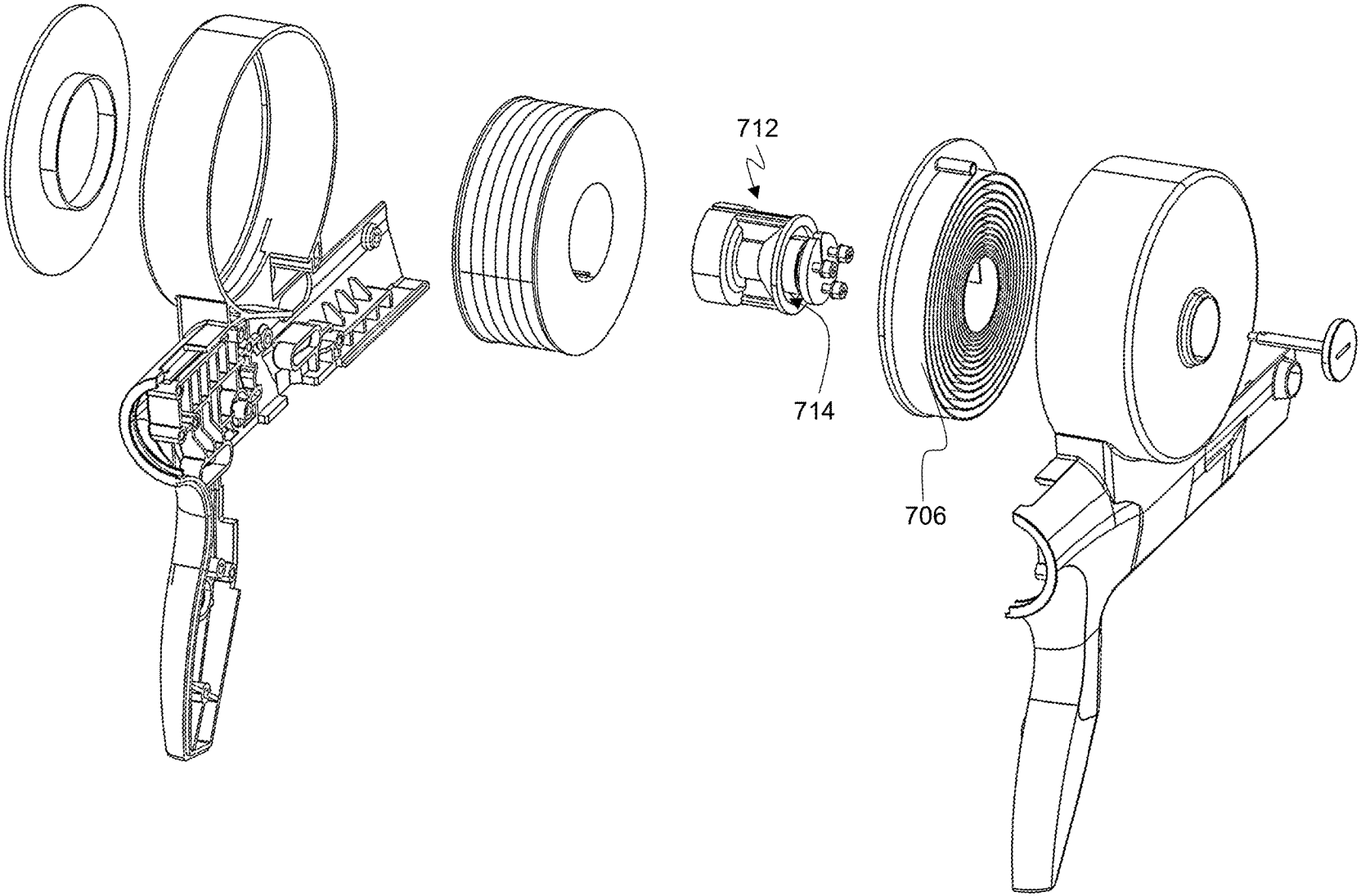
FIG. 6 illustrates an exploded perspective right-side rear view of the cable tie tool housing and reel magazine assembly, with the other mechanisms removed for simplicity.
Figure 7:
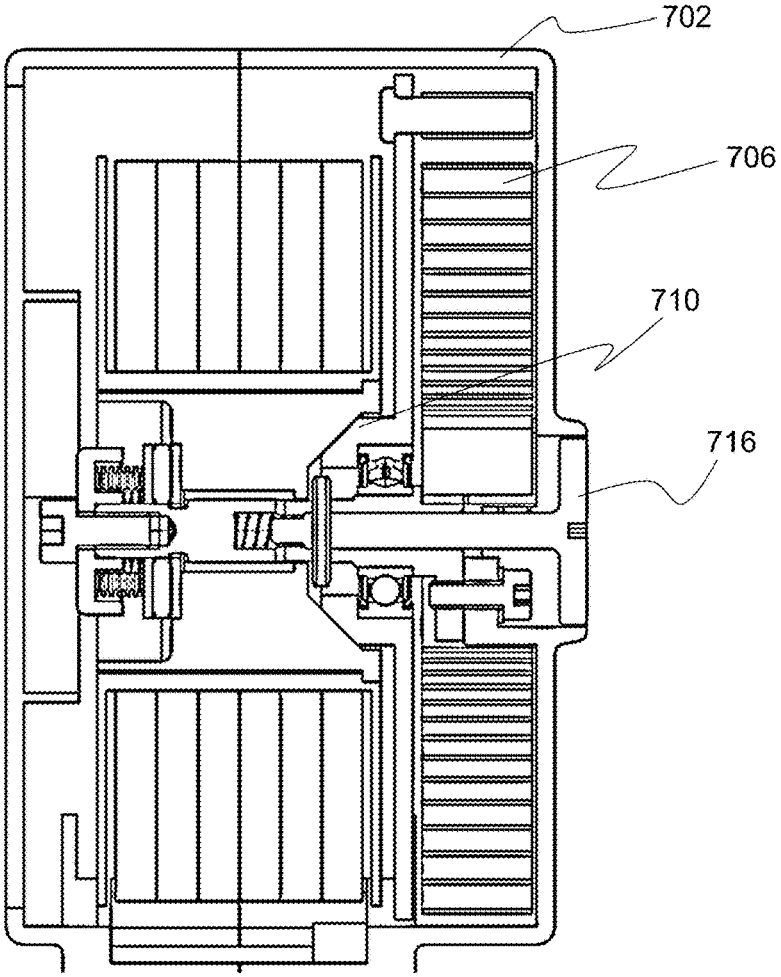
FIG. 7 illustrates (a) a partial cross-sectional view of the reel magazine assembly through a center plane, and (b) a cross-sectional perspective side view of the bearing hub of the reel magazine assembly, including the bias release mechanism (biased axial push button).
Figure 7:
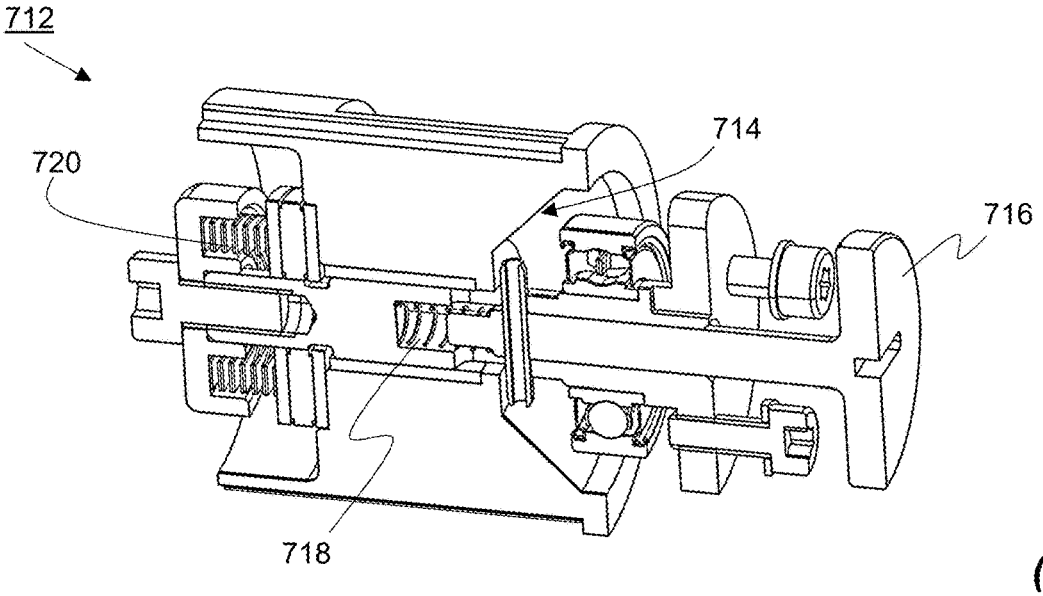

Referring now to FIGS. 5, 6 and 7, in particular, the reel magazine assembly 700 is operably coupled to a mid-section of the barrel portion 104 of the tool housing 102. Preferably, the reel housing 702 (made up of two halves, as is the tool housing 102) is integrally formed with the tool housing 102.

The reel magazine assembly 700 includes a reel biasing mechanism 704 comprising of a spiral spring 706 and an engagement disc 708 having a coaxially arranged conical engagement member 710 configured to operably engage with a bearing hub 712. The reel biasing mechanism 704 is configured to automatically rewind the cable tie strap 2002 onto the cable strap reel 2000, as well as provide a constant tension/bias of the cable tie strap 2002 fed into the tool 100. The bearing hub 712 is configured to retainingly receive a cable strap reel 2000 storing a plurality of wound-up cable tie straps 2002 and comprises an internal conical engagement portion 714 configured to matingly engage with the conical engagement member 710 of the engagement disc 708. In particular, in use, the conical engagement member 710 and the internal conical engagement portion 714 are shaped to matingly engage and provide a friction coupling between the bearing hub 712 and the engagement disc 708. The friction coupling is suitable to transfer rotational movement from the engagement disc 708 to the bearing hub 712 and vice vera. A push button 716 is coaxially coupled to the bearing hub 712 through the reel housing 702, such that axial movement of the push button 716 axially moves the bearing hub 712 between an engaged position, coupled to the conical engagement member 710 of the engagement disc 708, and a disengaged position, moved away from the engagement member 710 of the engagement disc 708. The push button 716, as well as the bearing hub 712 are biased towards the engaged position (see FIGS. 7(*a*) and (*b*)). The bias is provided by a compression spring 718 and a plurality of stacked compression spring discs 720. The reel housing 702 further comprises a removable cover 722 to enable installation and removal of the cable strap reel 2000.

During operation, a fully stored cable strap reel 2000 is mounted onto the bearing hub 712 through the opening provided by the removable cover 722 and an end portion of a cable tie strap 2002 is fed into the feeder guide mechanism 800 (described in section (viii)). After use, the cable strap reel 2000 is typically under a rotational bias tension from the reel biasing mechanism 704. To remove the biasing force, the push button 716 is axially depressed, thus, moving the bearing hub 712 out of engagement with the engagement member 710 of the engagement disc 708 and enabling the wound-up (or loaded) spiral spring 706 of the reel biasing mechanism 704 to unwind (or unload) freely. Once the rotational bias of the wound-up biasing mechanism 704 has been removed, the cable strap reel 2000 can be accessed or replaced via the removable cover 722 to then feed a new cable tie strap 2002 into the feeder guide mechanism 800. In addition, the cable strap reel 2000 may be made of a recycled cardboard material suitable to hold the one or more coiled cable tie straps 2002.

(viii) Feeder Guide Mechanism 800

Figure 8:
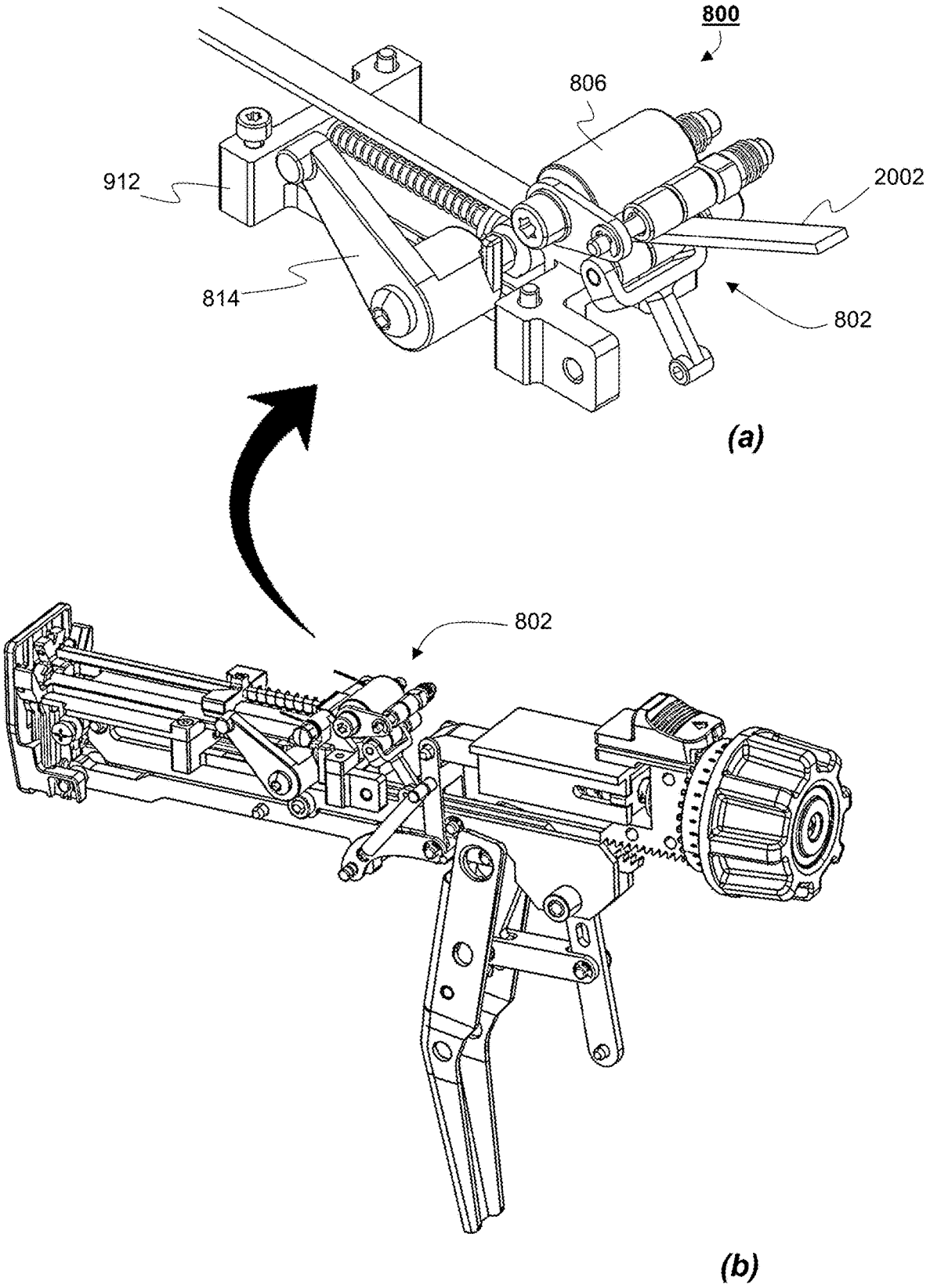
FIG. 8 illustrates (a) a detailed partial perspective view of the trigger lever and eccentric roller guide of the feeder guide mechanism, and (b) and perspective side view of the exposed tool mechanism without the locking heads magazine and reel magazine assembly, for simplicity.
Figure 9:
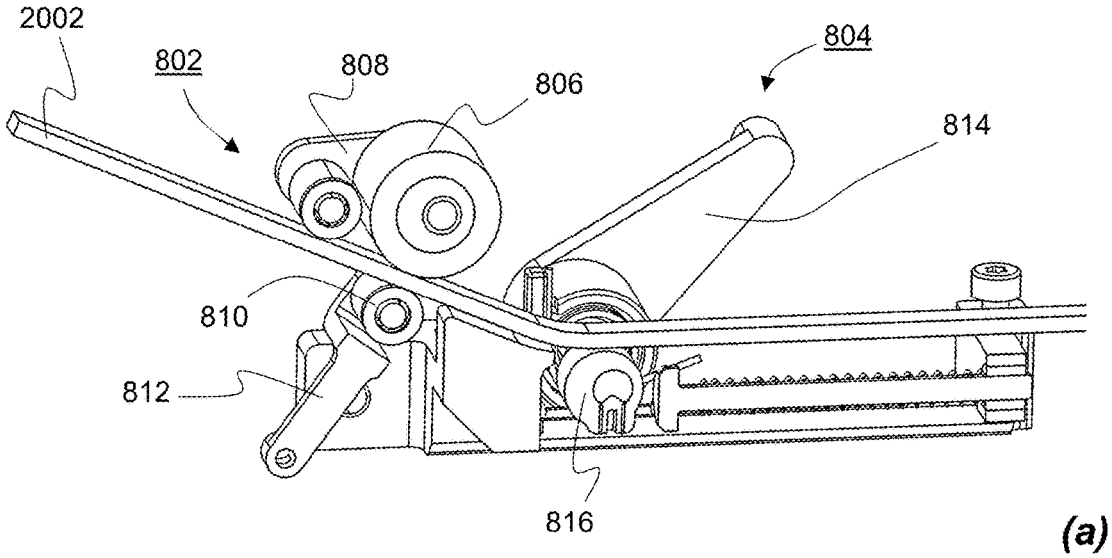
FIG. 9 illustrates (a) a perspective cross-sectional (center plane) side view of the feeder guide mechanism removed from the tool, and (b) a cross-sectional (center plane) partial side view of the feeder guide mechanism embedded within the tool mechanism.
Figure 9:
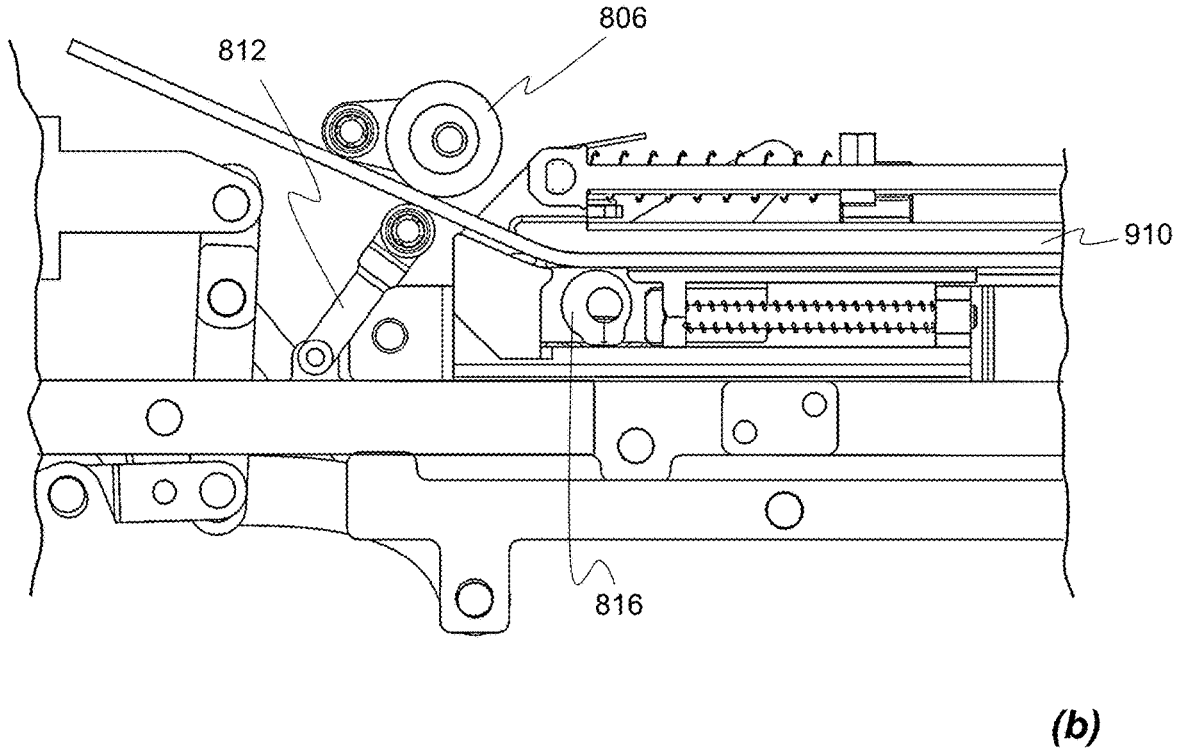
Figure 10:
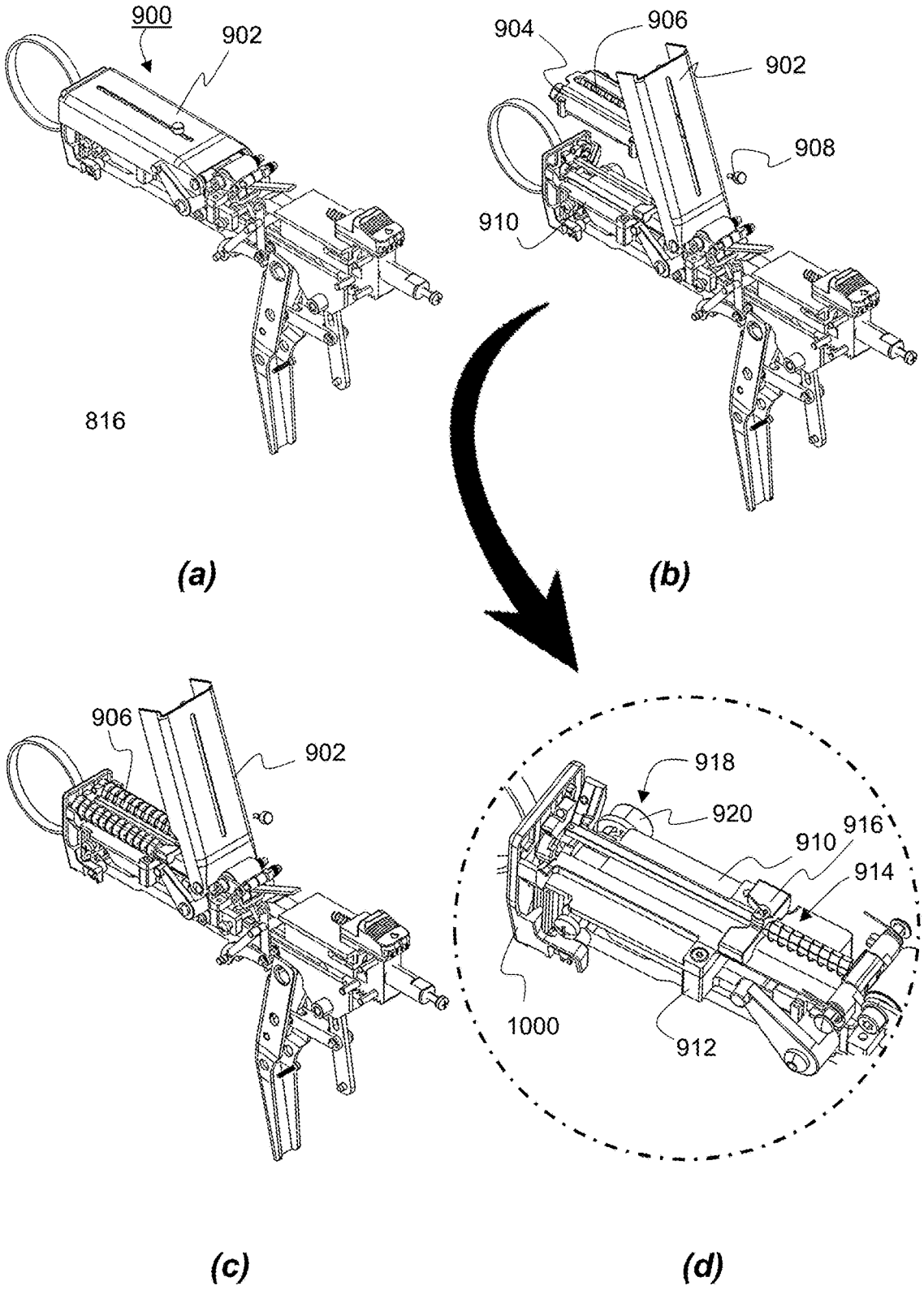
FIG. 10 illustrates a perspective rear view of the cable tie tool with (a) the tool heads magazine cover closed, (b) the tool heads magazine cover opened and the cartridge removed, (c) the tool heads magazine cover opened and the exposed locking heads placed within the magazine (for illustration only) and (d) a partial detailed view of the plunger mechanism with the cartridge and cover removed.

Referring now to FIGS. 8, 9 and 10, the feeder guide mechanism 800 is embedded between the magazine assembly 700 and the trigger, tension and locking mechanism 200, 300, and 400. In particular, the feeder guide mechanism 800 guides the cable tie straps 2002 from the reel 2000 through the barrel portion 104 out of the blade guard 1000 at the distal housing end portion 106, around the object(s) to be tied up and back into the barrel portion 104 for engagement with the gripping pawl 310 of the tension mechanism 200, ready to be tightened and cut. Thus, the feeder guide mechanism 800 provides two distinct functions.

First, it provides a unidirectional roller guide 802 for the cable tie strap 2002 from the reel 2000 (stored in the magazine assembly 700) into the barrel portion 104, configured to prevent or block the cable tie strap 2002 from being pulled back onto the spring-biased reel 2000 once the cable tie strap 2002 is cut and/or tension applied to the cable tie strap 2002 is released. The roller guide 802 will keep the cable tie strap 2002 in position for the next use until the whole coiled up cable tie strap has been used up.

Second, the feeder guide mechanism 800 provides for a manual slider 804 configured to "grab" an end portion of the cable tie strap 2002 and move it through and out of the barrel portion 104 to be pulled around one or more object(s) and pushed back into the barrel portion 104 for tensioning and cutting. The manual slider 804 is configured to enable repeated "grab" and "release" of the cable tie strap 2002 and move a section of the cable tie strap 2002 forward, while the roller guide 802 prevents the cable tie strap 2002 from being pulled back onto the biased reel 2000 when the manual slider 804 releases the cable tie strap 2002 to move back to its starting position.

The roller guide 802 comprises an eccentric upper roller member 806 rotatably mounted to a first pivot link 808, and a lower roller member 810 rotatably mounted to a second pivot link 812 and cooperatively facing the eccentric upper roller member 806. The upper and lower roller members 806 and 810 are arranged within the barrel portion 104 so as to guidingly "open" when the cable tie strap 2002 moves towards the distal end portion 106 of the tool 100, but "wedgingly" block the cable tie strap 2002 when moving back towards the proximal end portion 108 (i.e., back onto the biased reel 2000). In use, the eccentrically arranged roller member 806 and the lower roller member 810 arranged on a forward facing second pivot link 812 block any return movement of the cable tie strap 2002 by reducing the gap between the upper and lower roller member 806 and 810 and increasing the gripping force effected by the upper and lower roller member 806, 810 onto the cable tie strap

2002. Optionally, any one of the first and second pivot links 808, 812 may be biased towards the "closing" position.

Figure 11:
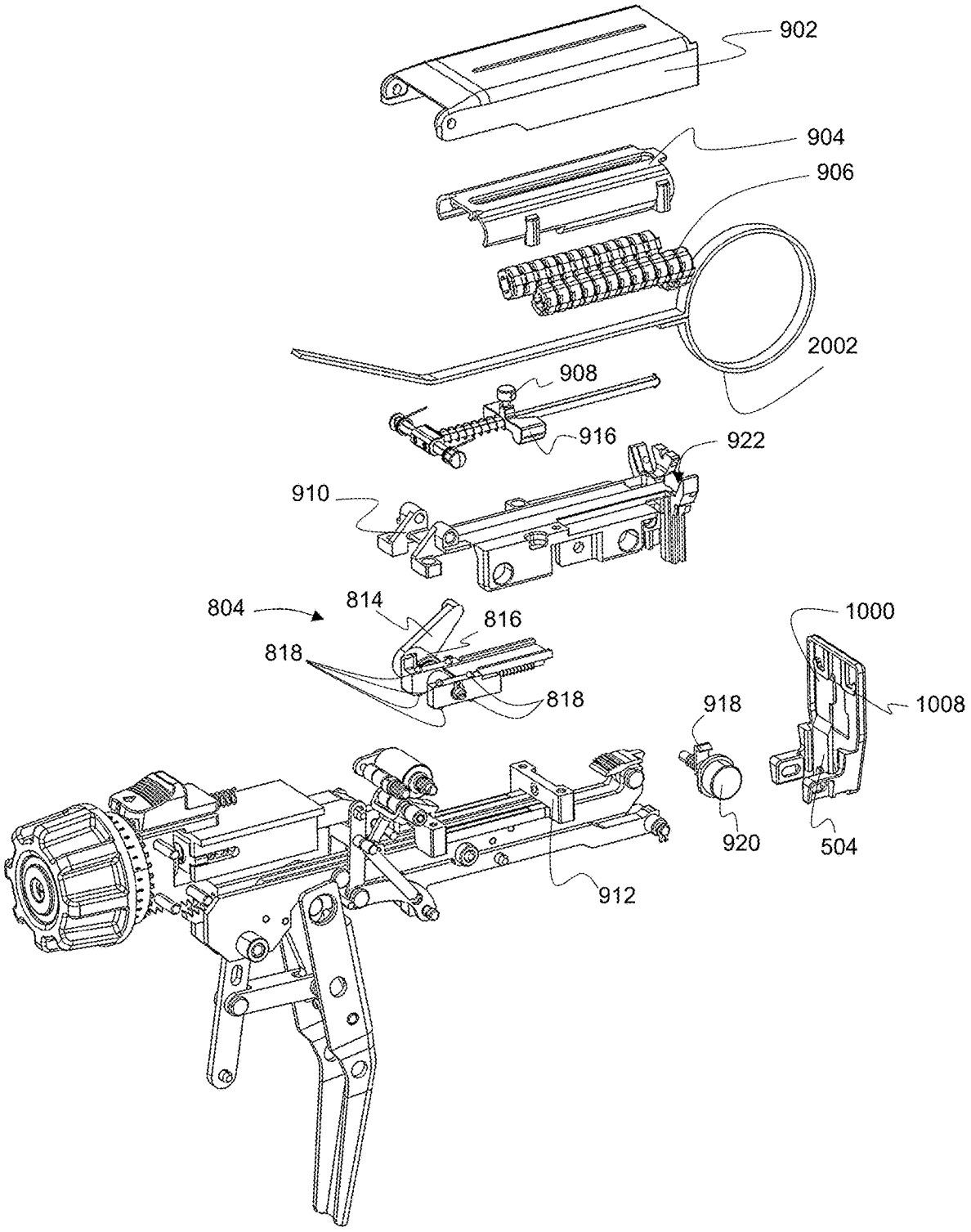
FIG. 11 shows an exploded view of the cable tie tool mechanism without the housing and reel magazine assembly.
Figure 12:
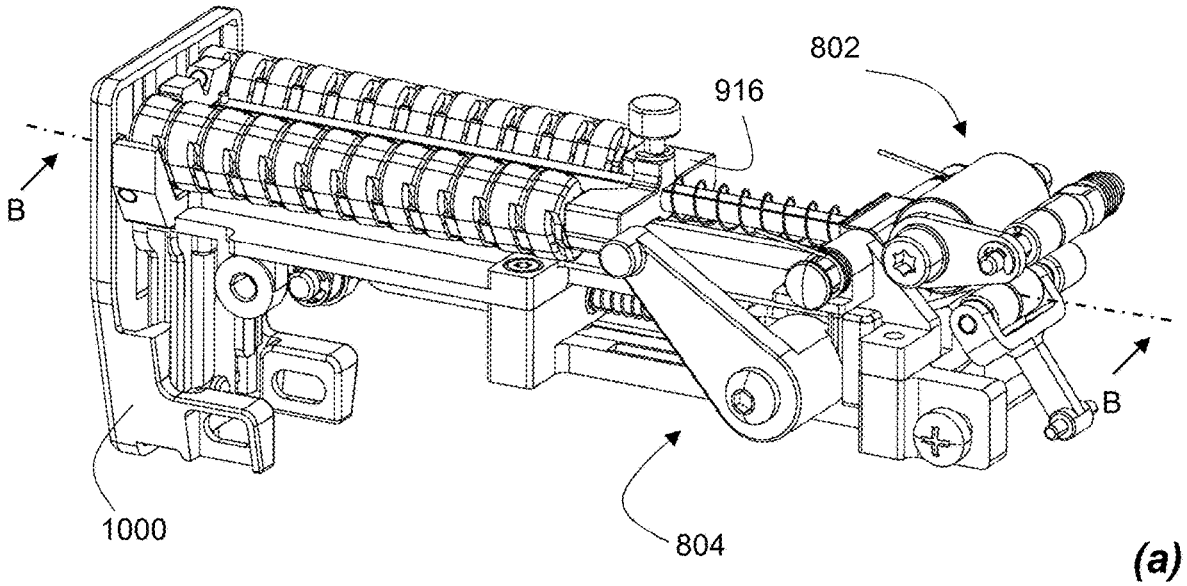
FIG. 12 illustrates (a) an exposed partial top view of the locking heads arranged in the locking heads magazine (cartridge and cover removed) and (b) an exposed cross-sectional partial side-view of the feeder guide mechanism, locking heads magazine and blade guard mechanism (reel magazine, cartridge and cover removed).
Figure 12:
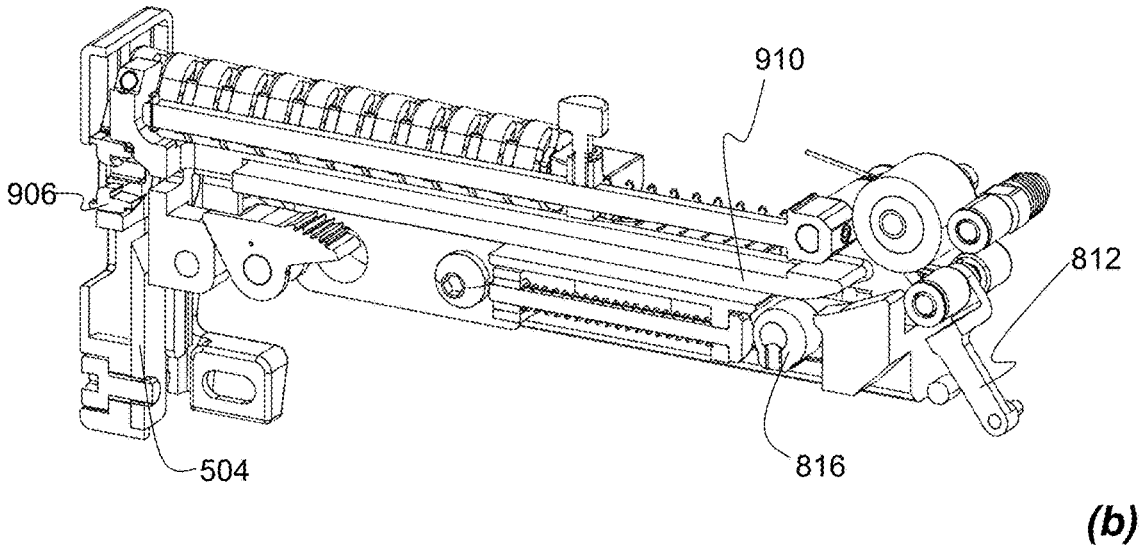

The manual slider 804 comprises a trigger member 814 rotatably and slidably mounted between an upper rack member 910 and a lower rack member 912 of the locking heads magazine assembly 900 (see FIG. 11, section (ix)). An eccentric roller 816 is rotatably mounted to the rotational axis of the trigger member 814 and arranged so as to be axially aligned with the cable tie strap 2002 when fed through the roller guide 802 into the barrel portion 104. The trigger member 814 and mounted eccentric roller 816 are configured to be rotated forward (i.e., anti-clockwise towards the distal end portion 106), so as to "grab" the cable tie strap 2002 with the eccentric roller 816 contactingly engaging the cable tie strap 2002, to then slidingly move from a proximal position towards a distal position, where the biased trigger member 814 is released to automatically rotate back to its starting position and disengaging its hold ("grab") on the cable tie strap 2002. The sliding movement of the manual slider 804 is also biased towards its starting position so that when releasing the trigger member 814, the trigger member 814 rotates back up (clockwise) and the manual slider 804 slides back to its starting position (towards the proximal end 108). The biasing force may be provided by any biasing mechanism, such as, for example, a compressing spring for the sliding movement and a torsion spring for the rotatable trigger lever 814.

During use, the trigger member 814 is rotated forward to "grab" an end portion of the cable tie strap 2002 with the contactingly engaging eccentric roller 816, to then slide the manual slider 804 and engaged cable tie strap 2002 forward, where the trigger member 814 is simply released to spring-biasingly rotate back and disengage the eccentric roller 816 from the cable tie strap 2002. At this point, the biased cable tie strap 2002 is prevented from moving back onto the biased reel 2000 by the unidirectional roller guide 802, so that the "grab" and "slide" action can be repeated until a desired length of cable tie strap 2002 is moved out of the barrel portion 104 of the tool 100.

The manual slider 804 is operably positioned between the upper and lower rack member 910, 912 and the sliding movement of the slider 804 may be facilitated by ball bearings 818 provided between respective upper and lower rack member 910, 912 and the manual slider 804.

(ix) Locking Head Magazine 900 and Moveable Blade Guard 1000

The tool 100 is provided with a magazine assembly 900 for storing the separate locking heads 906 and a movable blade guard 1000 configured to move a new locking head 906 into position for use with the next cable tie strap 2002.

Referring now particularly to FIGS. 10 to 13, the locking head magazine 900 comprises an upper rack member 910, a lower rack member 912, a spring-biased locking head cover 902, a locking heads cartridge 904 including a plurality of locking heads 906 and a spring-biased plunger 914. The locking head cover 902 is pivotably mounted, so as to rotatably move between an open position, enabling access to the inserted cartridge 904, and a closed position, securing the cartridge to the upper rack member 910 via a spring-biased hook mechanism 918, actuatable by a push button 920. The cover 902 is spring biased towards its open position. The cartridge 904 is used to store and correctly align (parallel) the locking heads 906. A spring biased plunger 914 is provided on the upper rack member 910, so as to operably engage with the locking heads 906 stored within the cartridge 904 and when placed into the locking heads magazine 900. In particular, the plunger 914 is configured to provide a biasing force onto the parallelly aligned locking heads 906, so as to push the locking heads 906 towards the distal end portion 106 (i.e., towards the blade guard 1000). The plunger 914 includes an offset head engagement member 916, so that, when the locking heads 906 are stored within the cartridge 914 and operably coupled with the plunger 914, the parallelly arranged rows of locking heads 906 are axially offset (i.e., only one locking head 906 is positioned at the forefront to be loaded next). Thus, when the blade guard 1000 is actuated, only that one locking head 906 is loaded and operably positioned for the next cable tie strap 2002, during use.

Preferably, the axial offset between the two rows of locking heads is about half a thickness of a locking head 906. A plunger screw 908 may be provided to indicate the amount of locking heads 906 left in the cartridge 904 when the cover 902 is closed. Here, the plunger screw 908 is mounted through the cover 902 and cartridge 904 and moves with the head engagement member 916.

In use, the locking heads cover 902 is opened by depressing the push button 920 and disengaging the hook 918 from the spring biased cover 902 (which will open automatically, when the plunger screw 908 is removed). The locking heads 906 are then placed into the cartridge 904 and the filled cartridge 904 is placed onto the upper rack member 910 with the engagement member 916 pushing against the two locking heads 906 at the proximal end, thus, axially offsetting the two rows by about half a locking head thickness (see FIGS. 12 and 13). The locking head cover 902 is then rotated back into its closed position and secured by the hook 918. The locking heads magazine 900 is now ready for use with the tool 100.

Referring now particularly to FIGS. 12 to 16, a movable blade guard 1000 is provided at the distal end portion 106, coupled to the distal end of the cutting lever 502, so as to slidably move up and down with the rotational movement of the cutting lever 502. The blade member 504 is mounted to the blade guard 1000 at its interior surface and slidably moves with the blade guard 1000.

Figure 15:
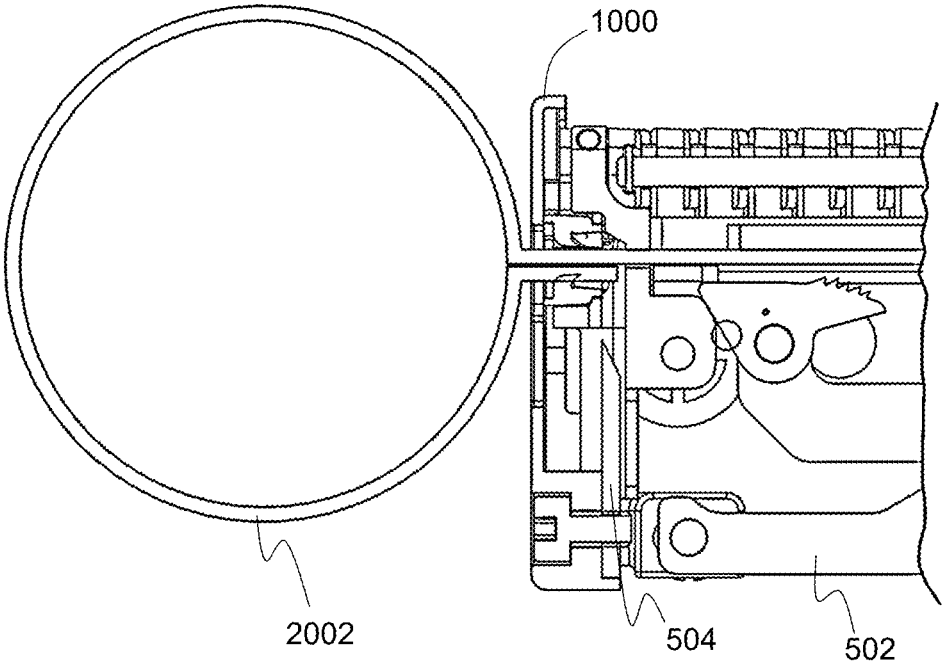
FIG. 15 illustrates a partial cross-sectional side view of the blade guard mechanism (a) in the lower, disengaged blade position and (b) in an upper, engaged blade position.
Figure 15:
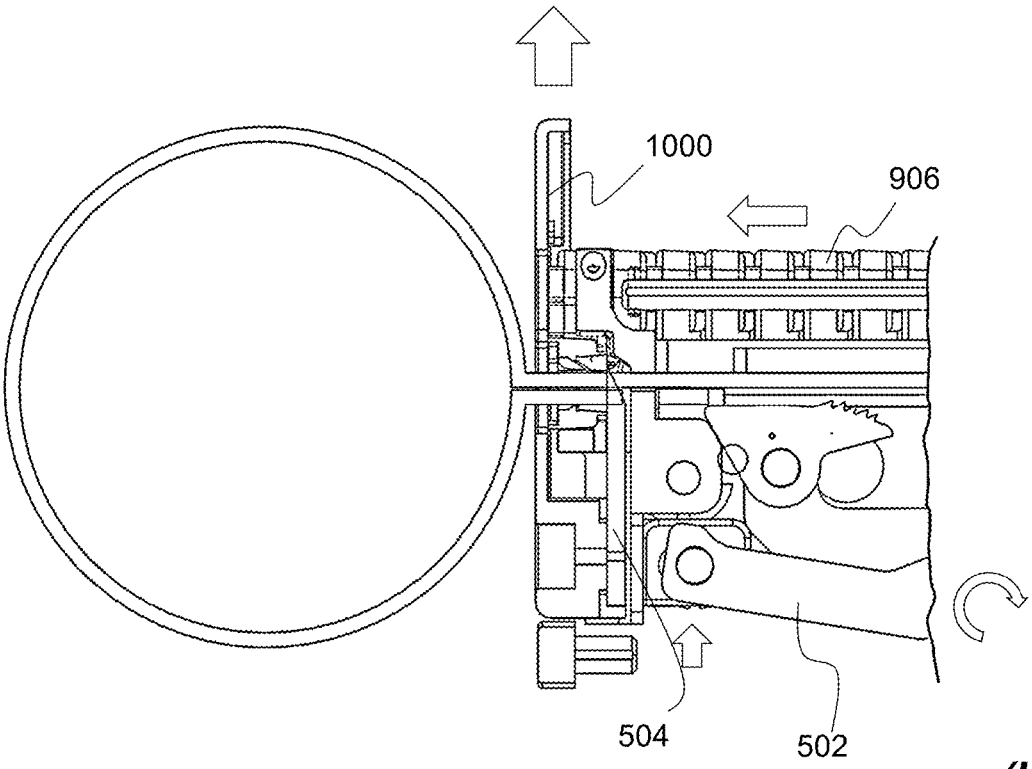

As shown in FIGS. 15(*a*) and (*b*), the blade guard 1000 is configured to moved up and down (with the blade member 504 and cutting lever 502 from the cutting mechanism 500). An exit aperture 1002, having a narrower upper portion 1004, preventing locking heads 906 from passing through, and a wider lower portion 1006, enabling a locking head 906 to pass through, is provided at a central portion of the blade guard 1000. The aperture 1002 enables the engaged and loaded locking head 906 to exit through the larger, wider portion 1006 of the aperture 1002 when the blade guard 1000 is moved up during the cutting of the cable tie strap 2002. Further, the blade guard comprises two head guides 1008 arranged at an interior surface of the blade guard 1000, so as to engage with the next locking head 906, during reloading. When the blade guard 1000 moves back down (after cutting), the head guide 1008 engages with the foremost locking head 906 and moves it into the loading position (i.e., behind the narrower upper portion 1004 of the aperture 1002).

Figure 13:
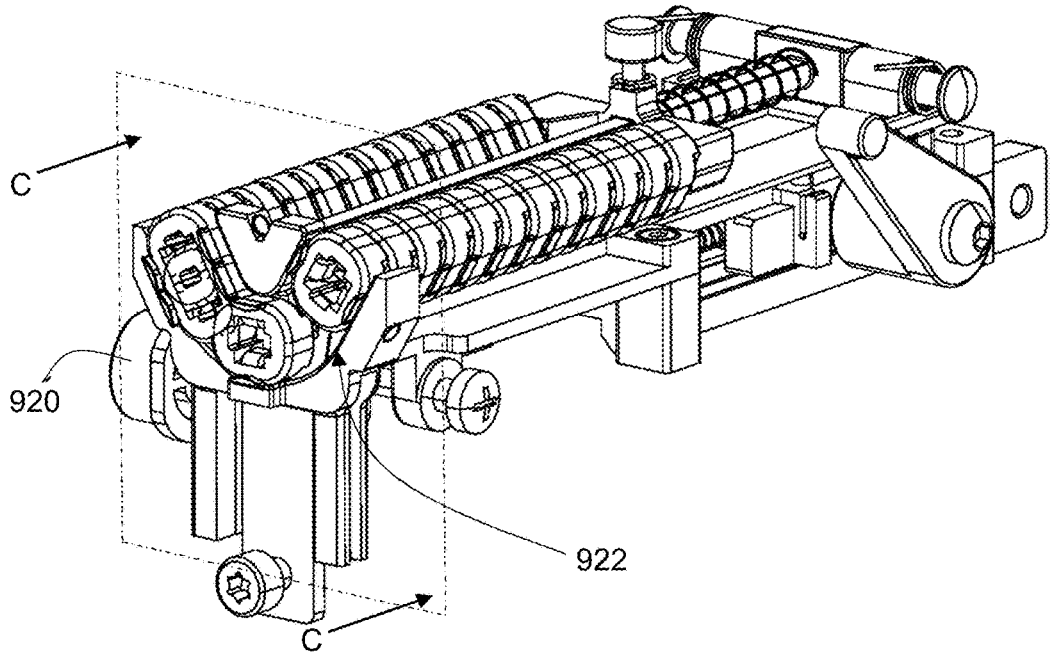
FIG. 13 illustrates (a) a perspective front view of the exposed locking heads magazine of FIG. 12(*a*) with the blade guard removed, and (b) a perspective cross sectional (C-C) front view of the exposed locking heads magazine of FIG. 13(*a*).
Figure 13:
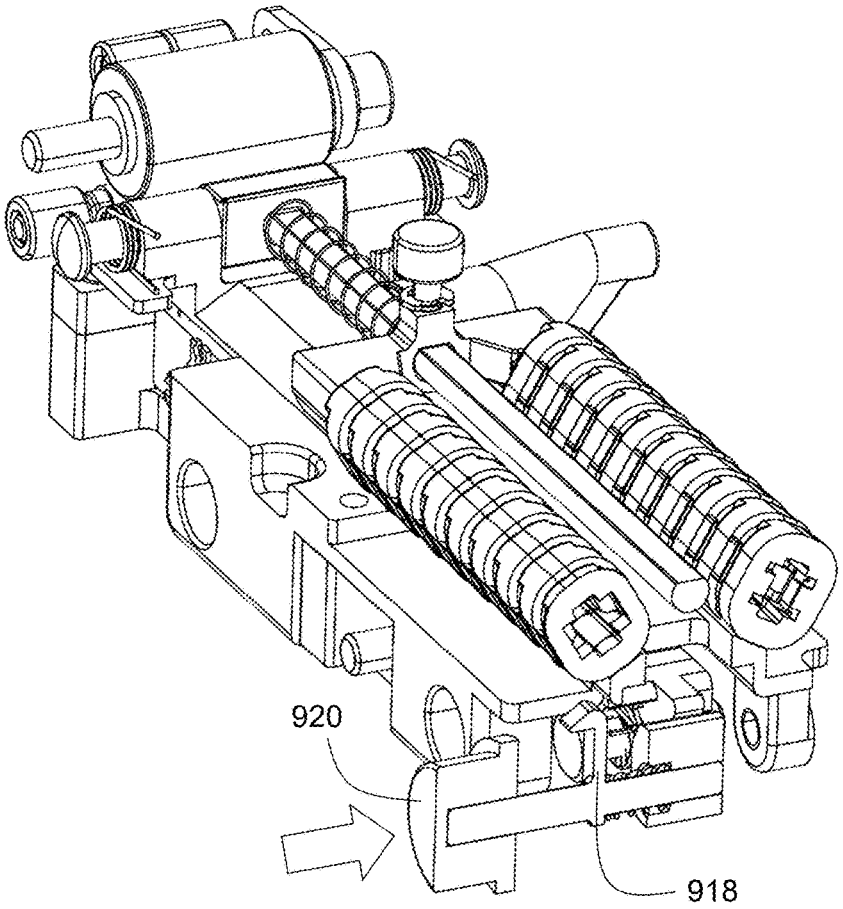
Figure 14:
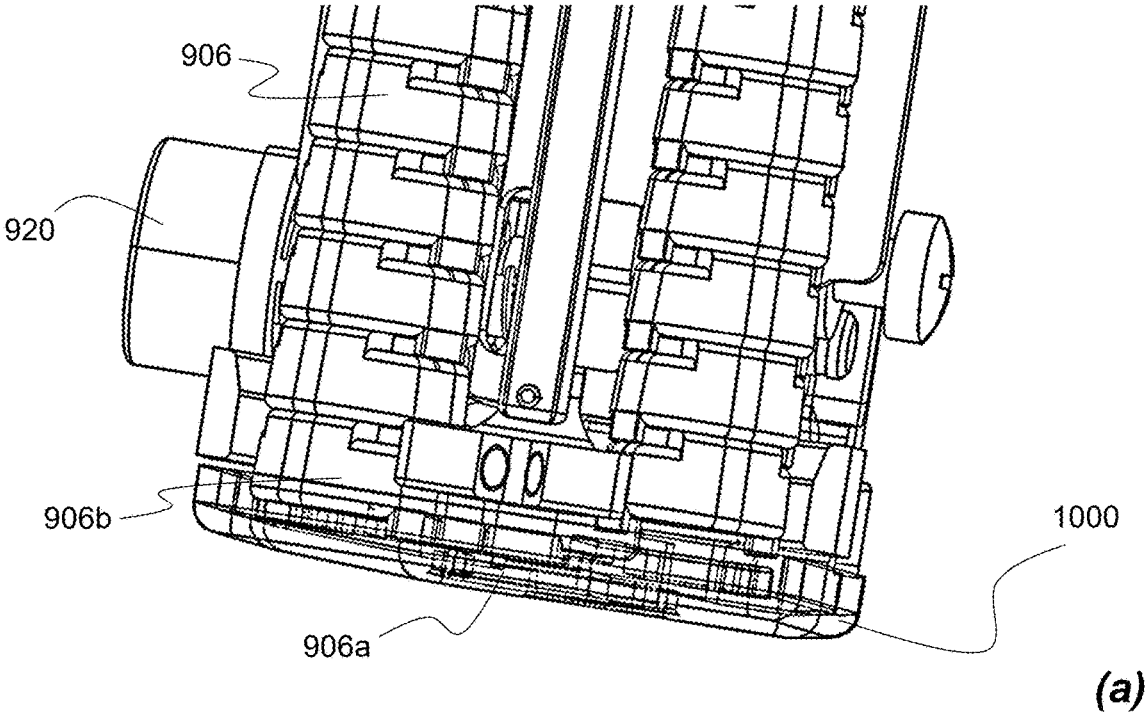
FIG. 14 illustrates the exposed locking heads magazine of FIG. 12(*a*) with a transparent blade guard (a) in a partial perspective top view and (b) in a partial perspective front view.
Figure 14:
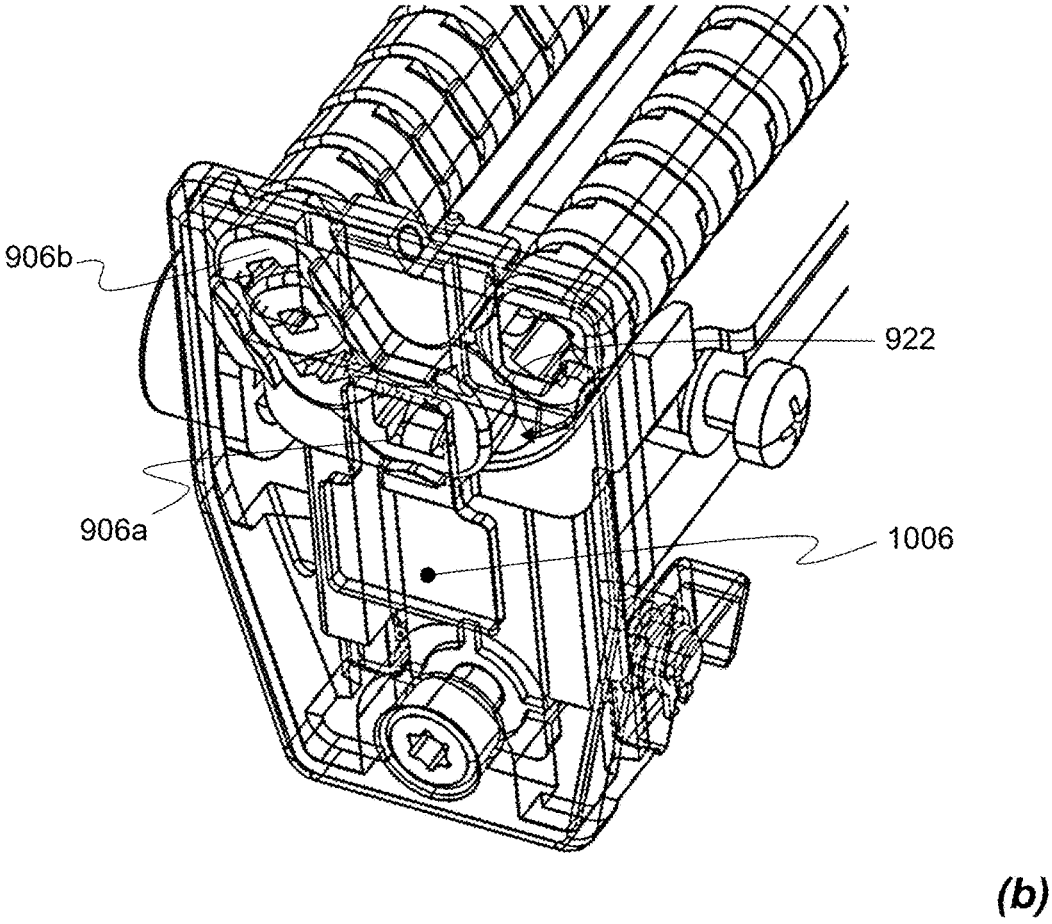

A left and right head guide 1008 is provided, because the foremost locking head 906 alternates sides due to the axial offset of the parallelly arranged rows of locking heads 906, so, whenever the blade guard 1000 moves back down, one of the head guides engages with the foremost locking head 906 and "drags" it down, along a lower guide surface 922 (provided at a distal end portion of the upper rack member 910) towards the center and into the loading position (see FIG. 13). FIG. 14 shows a perspective partial view of the distal end portion 106 of the tool 100 with the blade guard 1000 made transparent for ease of understanding. Here, the loaded locking head 906*a* is positioned centrally behind the narrower upper portion 1004 of the aperture 1002, the foremost locking head 906*b* of the cartridge 904 is on the left, ready for loading with the next cable tie strap 2002 (the cartridge 904 and cover 902 have been removed).

The cutting movement of the blade guard 1000 and mounted blade member 504 is shown FIGS. 15 (*a*) and (*b*) illustrating a cross-sectional partial side-view of the distal portion of the tool 100.

During use, the cutting lever 502 pivots up slidably moving the blade guard 1000 and mounted blade member 504 up so as to cut through the cable tie strap 2002. When cutting the cable tie strap 2002, the loaded locking head 906*a* is ejected through the wider lower portion 1006 of the aperture 1002, freeing up the central space of the lower guide surface 922 and enabling one of the guides 1008 to "drag" the foremost locking head 906*b* down along the lower guide surface 922 into the loading position for the next use.

Figure 16:
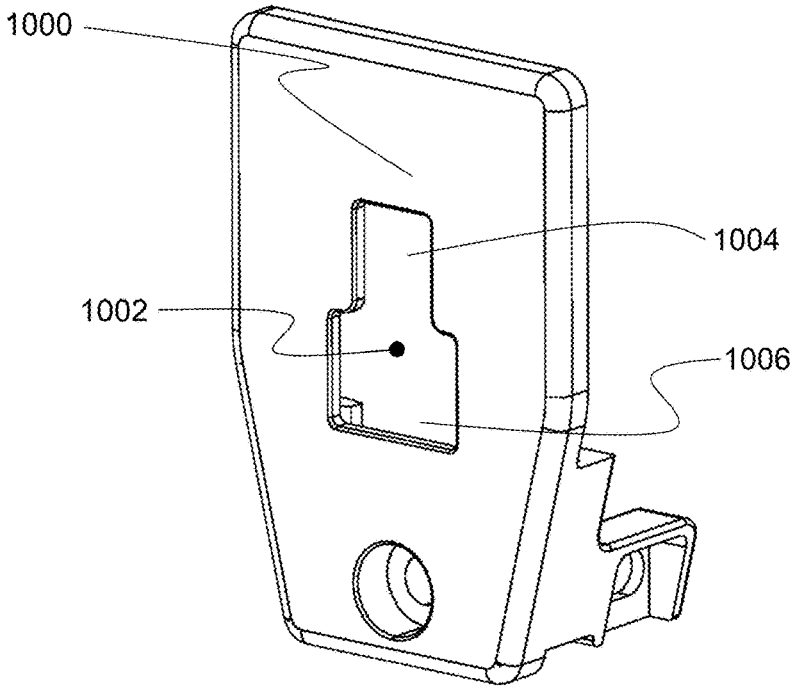
FIG. 16 illustrates (a) a perspective front view and (b) a perspective rear view of the blade guard and mounted blade.
Figure 16:
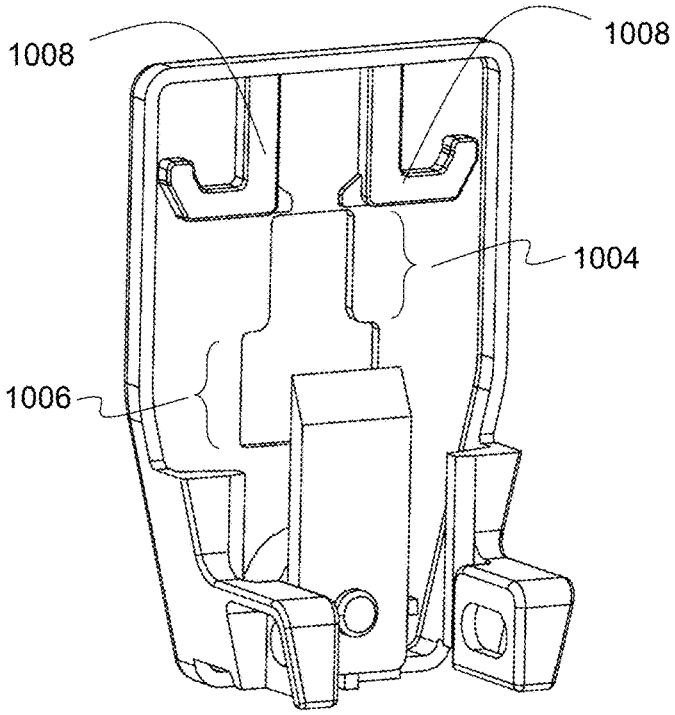
Figure 17:
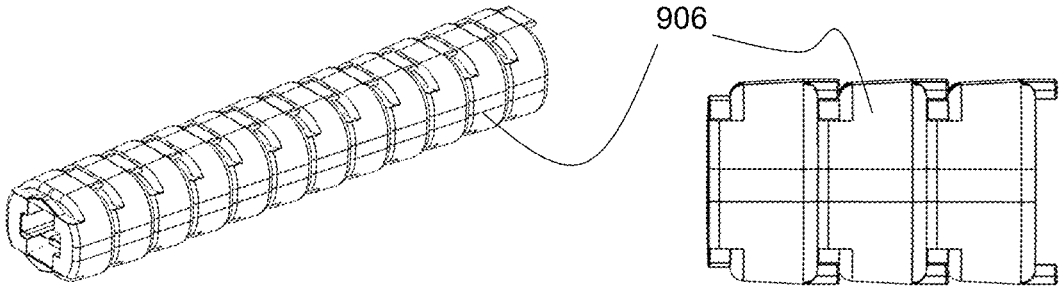
FIG. 17 shows a plurality of locking heads arranged in a row (or array) as stored in the cartridge (a) in a perspective front-side view, (b) in a top-view, a single locking head (c) in a perspective front view and (d) in a perspective rear view and (e) a top view of a cable tie strap looped around a structure and locked with a locking head.
Figure 17:
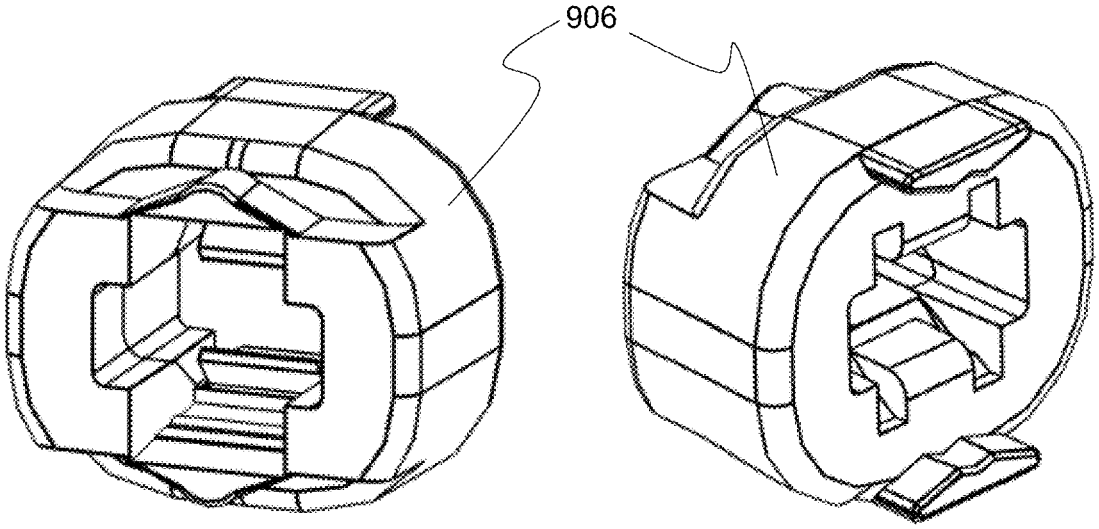
Figure 17:
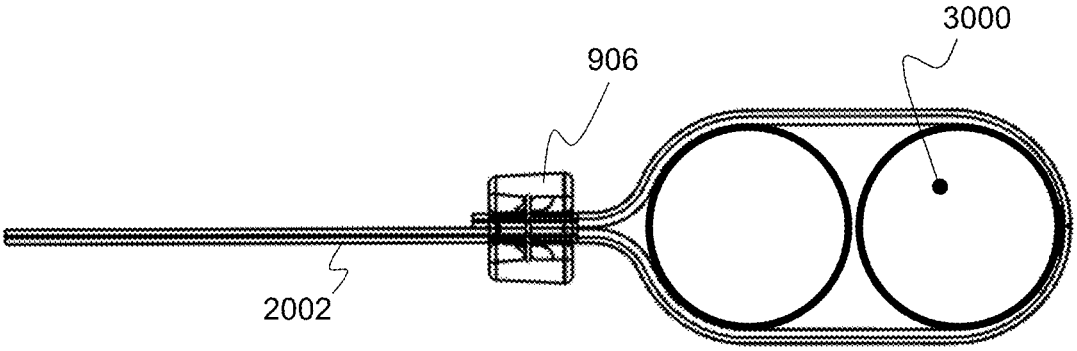

FIG. 16 shows and example of the locking heads array (a) and (b) as arranged within the cartridge 904, as well as a perspective (c) front- and (d) rear-view of an example configuration of a locking head 906 suitable for locking engagement with the cable tie strap 2002. FIG. 15(*e*) shows a schematic illustration of a cable tie strap 2002 wound and tensioned around a structure 3000 (e.g., two pipes or cables) and locked with an engaged locking head 906. The cable tie strap 2002 in FIG. 17(*e*) is not cut at the locking head, so as to better illustrate the arrangement between the strap 2002 and the locking head 906. Typically, the strap 2002 would be cut flush with the front surface of the locking head 906.

Figure 18:
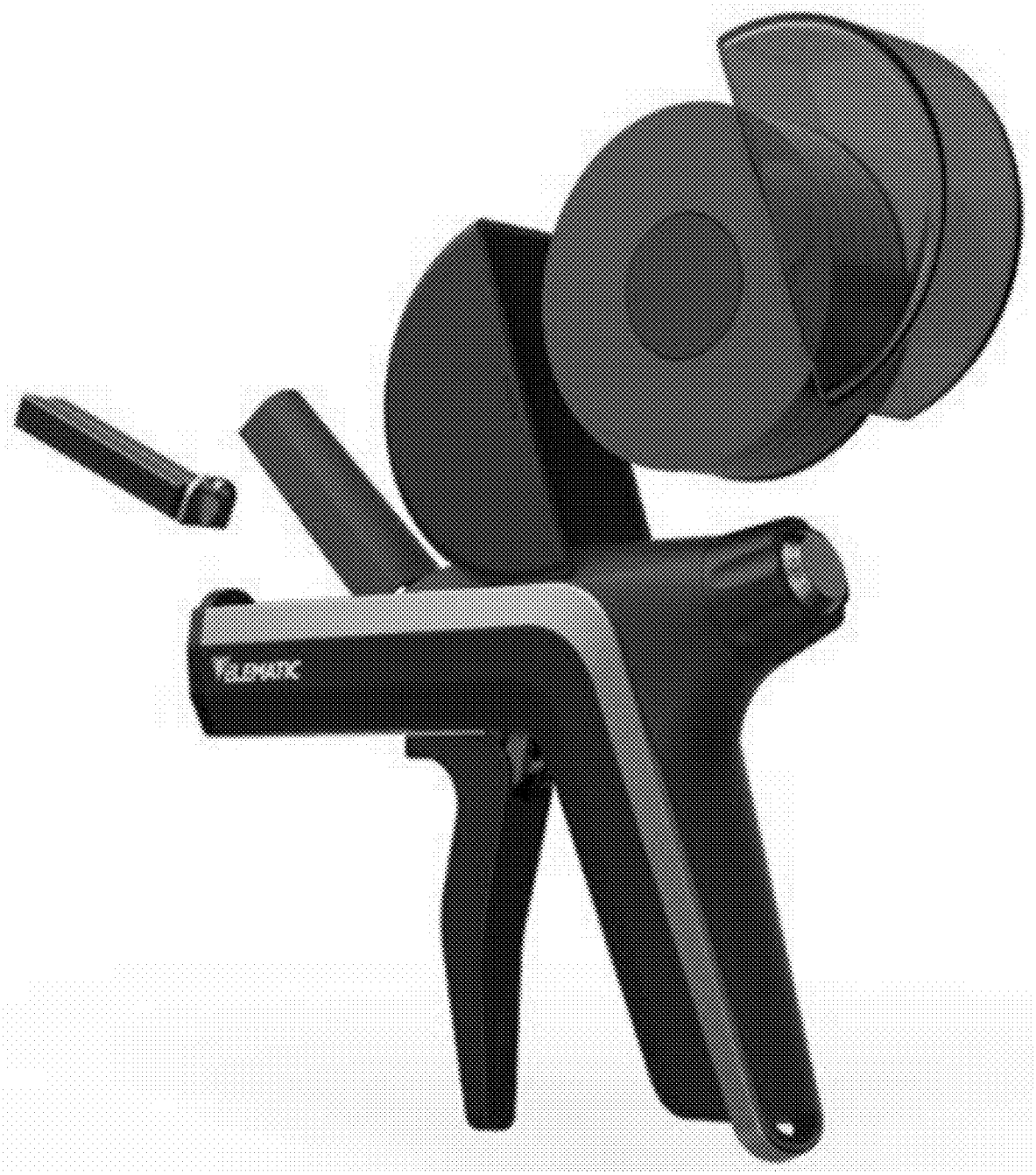
FIG. 18 illustrates an alternative embodiment of the cable tie tool of the present disclosure.

FIG. 18 shows an illustration of an alternative embodiment of the cable tie tool of the present disclosure, with the locking head magazine cover in an open position and a cartridge ready for insertion. Further, this alternative embodiment includes an alternative reel magazine housing with its cover and reel illustrated in an exploded view.

It will be appreciated by persons skilled in the art that the above embodiment(s) have been described by way of example only and not in any limitative sense, and that various alterations and modifications are possible without departing from the scope of the invention as defined by the appended claims. Various modifications to the detailed designs as described above are possible, for example, variations may exist in shape, size, arrangement (i.e., a single unitary components or two separate components), assembly or the like.

REFERENCE NUMBERS

100 Tool
102 housing
104 barrel portion
106 distal housing end portion
108 proximal housing end portion
110 longitudinal axis
112 handle portion
200 trigger mechanism
202 elongate trigger lever
204 inner trigger link
206 trigger housing portion
224 handle lever
230 short link
246 biasing member (torsion spring)
300 tension mechanism
302 pawl link
310 gripping pawl
400 locking mechanism
402 locking lever
404 stop member
406 proximal lever end
414 rack member
426 triangular teeth (stop member)
500 cut-off mechanism
502 cutting lever
504 blade member
514 cutting linkage
516 pivot link
528 tension spring
600 adjustable biasing mechanism
602 fulcrumed lever link
700 magazine assembly
702 reel housing
704 reel biasing mechanism
706 spiral spring
708 engagement disc
710 conical engagement member
712 bearing hub
714 Int. conical engagement
716 push button
718 compression spring
720 compression spring discs
722 magazine cover
800 feeder guide mechanism
802 roller guide
804 manual slider
806 upper roller member
808 first pivot link
810 lower roller member
812 second pivot link
814 trigger member
816 eccentric roller
818 ball bearings
900 locking heads magazine
902 locking heads cover
904 locking heads cartridge
906 locking heads
908 plunger screw
910 upper rack member
912 lower rack member
914 spring-biased plunger
916 head engagement member
610 spring housing
630 adjustment knob
918 spring-biased hook
920 push button
922 lower guide surface
1000 blade guard
1002 exit aperture
1004 upper portion
1006 lower portion
1008 head guides
2000 cable reel
2002 cable tie strap
3000 structure

The invention claimed is:

1. A tool for tensioning and severing a cable tie, the tool comprising:

a pistol-shaped housing having a barrel portion extending between a distal housing end portion and a proximal housing end portion along a longitudinal axis, and a handle portion extending away from said barrel portion in a direction different to said longitudinal axis;

a trigger mechanism comprising an elongate trigger member extending away from said barrel portion operably forward of said handle portion and configured to move toward and away from said handle portion;

a tension mechanism comprising a pawl link provided slidably reciprocatingly within said barrel portion along said longitudinal axis, operably coupled to said trigger mechanism, and configured to grippingly engage the cable tie and apply tension to a tie tail of the cable tie when moving said elongate trigger member toward said handle portion;

a locking mechanism in said barrel portion, operably coupled with said tension mechanism, and configured to stop operation of and lock said tension mechanism at a predetermined tension of the tie tail;

a cut-off mechanism in said barrel portion, operably coupled with said trigger mechanism and said locking mechanism, and configured to cut the tie tail when said locking mechanism is lockingly actuated;

a reel magazine assembly configured to retainingly receive at least one cable strap reel and provide for a spring-biased rotation of said at least one cable strap reel about a cable strap reel center axis, wherein said spring-biased rotation is directed so as to wind up a cable tie strap coiled up onto said cable strap reel;

a feeder guide mechanism in said barrel portion and configured to guidingly receive an end portion of said cable tie strap of said cable strap reel and move said cable tie strap from said cable strap reel through said barrel portion towards said distal housing end portion, but prevent movement of said cable tie strap back towards said cable strap reel;

a locking heads magazine assembly configured to store a plurality of locking heads and supply one locking head at a time for use with said cable tie strap; and a blade guard operably coupled between said cut-off mechanism and said locking heads magazine assembly and configured to receive and move said locking head from said locking heads magazine assembly into a loading position, ready for engagement with said cable tie strap.

2. The tool of claim 1, wherein said blade guard is moveable between a first position, retaining said locking head in said loading position, and a second position, releasing said locking head through an aperture of said blade guard, while moving another one of said plurality of locking heads into said loading position.

3. The tool of claim 2, wherein said blade guard comprises a blade member configured to cut through said cable tie strap when moved into said second position.

4. The tool of claim 3, wherein movement of said blade guard is actuated by said cut-off mechanism.

5. The tool of claim 1, wherein said reel magazine assembly comprises a reel biasing mechanism configured to provide said spring biased rotation and selectively releasably couplable with a hub member receiving said cable strap reel.

6. The tool of claim 5, wherein said reel magazine assembly comprises a release mechanism configured to disengage said reel biasing mechanism from said hub member.

7. The tool of claim 1, wherein said feeder guide mechanism comprises a roller guide configured to enable movement of said cable tie strap towards said distal housing end portion and prevent movement of said cable tie strap back towards said cable strap reel.

8. The tool of claim 1, wherein said feeder guide mechanism comprises a manual slider mechanism, configured to grippingly engage with a portion of said cable tie strap and slidingly move between a first trigger position, adjacent to said roller guide, and a second trigger position, spaced apart from said roller guide towards said distal housing end portion.

9. The tool of claim 8, wherein said manual slider mechanism is biased towards said first trigger position.

10. The tool of claim 1, wherein said locking heads magazine assembly is configured to bias said plurality of locking heads towards said blade guard.

11. The tool of claim 10, wherein said locking heads magazine assembly is configured to retain two parallelly arranged rows of said plurality of locking heads, such that one row of said plurality of locking heads is axially offset relative to another one of the rows of said plurality of locking heads, by a distance equivalent to half of a thickness of one of said plurality of locking heads.

12. The tool of claim 11, wherein said locking heads magazine assembly further comprises a level indicator, configured to indicate the number a quantity of locking heads left in said locking heads magazine assembly.

13. The tool of claim 12, wherein said locking heads magazine assembly further comprises a pivot cover, movable between a closed position, covering said plurality of locking heads, and an open position, enabling access to said plurality of locking heads.

14. The tool of claim 13, wherein said pivot cover is biased towards said open position and lockingly engaged with a releasable hook mechanism when in said closed position.

* * * * *